US011411357B2

(12) United States Patent
Shih

(10) Patent No.: US 11,411,357 B2
(45) Date of Patent: Aug. 9, 2022

(54) ELECTRONICS UNIT FOR MANAGED CONNECTIVITY, PATCH PANEL INCORPORATING THE SAME, METHODS OF INSTALLATION AND USE

(71) Applicant: COMMSCOPE, INC. OF NORTH CAROLINA, Hickory, NC (US)

(72) Inventor: Yi-Teh Shih, Richardson, TX (US)

(73) Assignee: COMMSCOPE, INC. OF NORTH CAROLINA, Hickory, NC (US)

( * ) Notice: Subject to any disclaimer, the term of this patent is extended or adjusted under 35 U.S.C. 154(b) by 757 days.

(21) Appl. No.: 16/316,292

(22) PCT Filed: Jul. 6, 2017

(86) PCT No.: PCT/US2017/040892

§ 371 (c)(1),
(2) Date: Jan. 8, 2019

(87) PCT Pub. No.: WO2018/009658

PCT Pub. Date: Jan. 11, 2018

(65) Prior Publication Data

US 2021/0376545 A1 Dec. 2, 2021

Related U.S. Application Data

(60) Provisional application No. 62/408,189, filed on Oct. 14, 2016, provisional application No. 62/360,097, filed on Jul. 8, 2016.

(51) Int. Cl.
*H01R 25/00* (2006.01)
*H01R 13/631* (2006.01)
(Continued)

(52) U.S. Cl.
CPC ..... *H01R 25/00* (2013.01); *H01R 13/631* (2013.01); *H01R 13/639* (2013.01);
(Continued)

(58) Field of Classification Search
CPC .. H01R 13/641; H01R 13/6658; H01R 24/64; H01R 13/631; H01R 13/639;
(Continued)

(56) References Cited

U.S. PATENT DOCUMENTS 6,522,737 B1 2/2003 Bartolutti et al.
6,574,586 B1 6/2003 David et al.
(Continued)

FOREIGN PATENT DOCUMENTS

JP 2005-209387 A 8/2005
WO 2011/047281 A1 4/2011
WO 2011/049967 A1 4/2011

OTHER PUBLICATIONS

International Search Report and Written Opinion of the International Searching Authority for International Patent Application No. PCT/US2017/040892 dated Oct. 17, 2017, 16 pages.

*Primary Examiner* — Gary F Paumen
(74) *Attorney, Agent, or Firm* — Merchant & Gould P.C.

(57) ABSTRACT

An electronics units for providing intelligence to a patch panel includes spaced plug guides, a circuit board, and contacts with connection points that are movable relative to the circuit board in response to contact with a plug. The electronics unit can be used as part of a patch panel assembly and can be retrofittable into the patch panel.

20 Claims, 28 Drawing Sheets

(51) Int. Cl.

| | |
|---|---|
| ***H01R 13/639*** | (2006.01) |
| ***H01R 13/703*** | (2006.01) |
| ***H01R 43/26*** | (2006.01) |
| ***H01R 13/405*** | (2006.01) |
| ***H01R 13/518*** | (2006.01) |

(52) U.S. Cl.
CPC ..... *H01R 13/7033* (2013.01); *H01R 43/26* (2013.01); *H01R 13/405* (2013.01); *H01R 13/518* (2013.01); *H01R 2201/04* (2013.01)

(58) Field of Classification Search
CPC H01R 13/7033; H01R 13/405; H01R 13/518; H01R 25/00; H01R 43/26; H01R 2201/04
USPC ..... 439/620.21–620.23, 676, 955
See application file for complete search history.

(56) References Cited

U.S. PATENT DOCUMENTS

| | | | | |
|---|---|---|---|---|
| 7,077,710 | B2 | 7/2006 | Haggay et al. | |
| 7,123,810 | B2 | 10/2006 | Parrish | |
| 7,226,217 | B1 | 6/2007 | Benton et al. | |
| 7,234,944 | B2 * | 6/2007 | Nordin | H04Q 1/136 439/49 |
| 7,297,018 | B2 | 11/2007 | Caveney et al. | |
| 7,479,032 | B2 | 1/2009 | Hoath et al. | |
| 7,563,102 | B2 * | 7/2009 | Nordin | H04Q 1/136 439/49 |
| 8,992,260 | B2 * | 3/2015 | Coffey | H01R 24/60 439/620.22 |
| 9,007,206 | B2 * | 4/2015 | Chen | H04Q 1/13 340/540 |
| 9,049,499 | B2 * | 6/2015 | Nordin | H04Q 1/136 |
| 9,054,440 | B2 | 6/2015 | Taylor et al. | |
| 9,401,552 | B2 * | 7/2016 | Coffey | H01R 12/70 |
| 9,454,501 | B2 * | 9/2016 | Dearing | G06F 13/385 |
| 9,595,797 | B2 | 3/2017 | Taylor et al. | |
| 9,769,939 | B2 | 9/2017 | Coffey et al. | |
| 9,967,983 | B2 | 5/2018 | Coffey et al. | |
| 10,177,514 | B2 | 1/2019 | Taylor et al. | |
| 2009/0275216 | A1 | 11/2009 | Nordin et al. | |
| 2011/0092100 | A1 | 4/2011 | Coffey et al. | |
| 2011/0189886 | A1 | 8/2011 | Chen | |
| 2015/0039788 | A1 | 2/2015 | Dearing et al. | |
| 2018/0332723 | A1 | 11/2018 | Coffey et al. | |
| 2019/0140411 | A1 | 5/2019 | Taylor et al. | |

* cited by examiner

ELECTRONICS UNIT FOR MANAGED CONNECTIVITY, PATCH PANEL INCORPORATING THE SAME, METHODS OF INSTALLATION AND USE

CROSS-REFERENCE TO RELATED APPLICATIONS

This application is a National Stage Application of PCT/US2017/040892, filed on Jul. 6, 2017, which claims the benefit of U.S. Patent Application Ser. No. 62/360,097, filed on Jul. 8, 2016, and claims the benefit of U.S. Patent Application Ser. No. 62/408,189, filed on Oct. 14, 2016, the disclosures of which are incorporated herein by reference in their entireties. To the extent appropriate, a claim of priority is made to each of the above disclosed applications.

BACKGROUND

Telecommunications networks typically include numerous logical communication links between various items of equipment. Often a single logical communication link is implemented using several pieces of physical communication media. For example, a logical communication link between a computer and an inter-networking device such as a hub or router can be implemented as follows. A first cable connects the computer to a jack mounted in a wall. A second cable connects the wall-mounted jack to a port of a patch panel, and a third cable connects the inter-networking device to another port of a patch panel. A "patch cord" cross connects the two together. In other words, a single logical communication link is often implemented using several segments of physical communication media.

Network management systems (NMS) are typically aware of the logical communication links that exist in a network but typically do not have information about the specific physical layer media that are used to implement the logical communication links. Indeed, NMS systems typically do not have the ability to display or otherwise provide information about how logical communication links are implemented at the physical layer level.

Physical layer management (PLM) systems do exist. However, existing PLM systems are typically designed to facilitate the adding, changing, and removing of cross connections at a particular patch panel or a set of patch panels in at a given locations. Generally, such PLM systems include functionality to track what is connected to each port of a patch panel, trace connections that are made using a patch panel, and provide visual indications to a user at a patch panel. However, such PLM systems are typically "patch-panel" centric in that they are focused on helping a technician correctly add, change, or remove cross connections at a patch panel. Any "intelligence" included in or coupled to the patch panel is typically only designed to facilitate making accurate cross connections at the patch panel and trouble shooting related problems (for example, by detecting whether a patch cord is inserted into a given port and/or by determining which ports are coupled to one another using a patch cord).

Moreover, any information that such PLM systems collect is typically only used within the PLM systems. In other words, the collections of information that such PLM systems maintain are logical "islands" that are not used at the application-layer level by other systems. Though such PLM systems are sometimes connected to other networks (for example, connected to local area networks or the Internet), such network connections are typically only used to enable a user to remotely access the PLM systems. That is, a user remotely accesses the PLM-related application-layer functionality that resides in the PLM system itself using the external network connection but external systems or networks typically do not themselves include any application-layer functionality that makes use of any of the physical-layer-related information that resides in the PLM system.

SUMMARY

In general, an electronics unit for providing intelligence to a patch panel that improves the prior art.

In one aspect, an electronics unit for mounting into a patch panel having a plurality of ports is provided including a base having a holding section and a plurality of spaced plug guides extending from one edge. A circuit board is secured to the holding section of the base. The circuit board includes at least one connector for connection to a management system and a plurality of contacts soldered to the circuit board. The contacts have connection points that are movable relative to the circuit board in response to contact with a plug that has been inserted into a port in the patch panel.

The cover plate can be secured to the base with the circuit board therebetween.

The cover plate can include one or more LEDs in communication with the circuit board.

The cover plate may include one or more buttons in communication with the circuit board for indicating a circuit track for an associated port in the patch panel.

The base may include a plurality of windows, and each of the contacts in the circuit board can be in communication with one of the windows in the base.

The base may include a channel, with a first plurality of the windows being open to the channel and a second plurality of windows being blocked from the channel. A conductive wire can be held by the channel. The contacts in communication with the first plurality of windows may be in electrical contact with the conductive wire when there is no plug inserted in a port in the patch panel. The contacts in communication with the second plurality of windows are blocked from contact with the conductive wire.

The circuit board can include a slot for each contact to permit axial motion of each contact and prevent lateral motion of each contact.

Each contact has a first end movable relative to a second end. Certain examples contacts are spring contacts. In certain implementations, the spring contacts can be pre-loaded when installed in the electronics unit.

In certain examples, each contact can be a stamped metal piece with at least two bends. Each contact can include an over molded plastic piece with a projecting bump to block electrical connection with an adjacent contact.

The base can have a first side and an opposite second side, with the first side defining the holding section. A plurality of hooks may extend from the second side.

The base can have a top edge and a bottom edge, with the spaced plug guides extending from the bottom edge.

The base can include a plurality of web stiffeners.

In another aspect, a patch panel is provided. The patch panel includes a frame; at least one chassis held by the frame, the chassis including a plurality of ports adapted to receive plugs, the plugs having one or more plug management contact; and an electronics unit held by the chassis including a circuit board and electronics unit contacts for electronic communication with the one or more plug management contacts. The electronics unit is retrofittable into the patch panel.

In one embodiment, the patch panel further includes a face plate mounted to the frame to lock the electronics unit between the face plate and chassis.

The electronics unit can include at least one hook extending therefrom. The at least one chassis includes a receiving cavity. The at least one hook can extend into the receiving cavity and engage a portion of the at least one chassis.

In some embodiments, the electronics unit includes a plurality of spaced plug guides extending therefrom, with each plug guide being adjacent to one of the ports.

In one or more embodiments, the electronics unit the patch panel can include a base with a plurality of spaced plug guides and a circuit board secured to the base. The circuit board can include at least one connector for connection to a management system. The plurality of electronics unit contacts are secured to the circuit board. The electronics unit contacts have connection points that are movable relative to the circuit board in response to contact with a plug that has been inserted into a port in the patch panel.

The patch panel may further include at least one plug operably mounted in one of the ports. The at least one plug has one or more plug management contacts in electrical communication with the electronic unit contacts of the electronics unit. The at least one plug moves the electronics unit contacts in an axial direction when operably mounted in the port.

In some embodiments, the base of the electronics unit includes a plurality of windows, and each of the electronics unit contacts in the circuit board are in communication with one of the windows in the base.

In some implementations, the electronics unit includes a channel, a first plurality of the windows being open to the channel, a second plurality of the windows being blocked from the channel, and a conductive wire being held by the channel. The electronics unit contacts in communication with the first plurality of windows are in electrical contact with the conductive wire when there is no plug inserted in a port in the patch panel. The electronics unit contacts in communication with the second plurality of windows are blocked from contact with the conductive wire.

In some implementations, the patch panel further includes at least one plug operably mounted in one of the ports, the at least one plug having one or more plug management contacts in electrical communication with the electronics unit contacts of the electronics unit. The plug moves the electronics unit contacts out of electrical contact with the conductive wire.

In some embodiments, one of the plug guides is adjacent to the at least one plug.

In one or more embodiments, the plug for the patch panel includes a body having first and second opposite walls, first and second opposite sides between the first and second walls, and opposite first and second ends between the first and second walls. The first end has an opening for receiving an electrical cable. The second end has a plurality of metal contacts. The first wall has at least one or more of the plug management contacts extending in a plane and a non-volatile memory device, such as an EEPROM, in communication with the at least one or more plug management contacts.

In some embodiments, the at least one chassis includes a plurality of chassis, each chassis having a plurality of ports, and each chassis being held by the frame. The electronics unit includes at least three electronics unit contacts associated with each of the ports. A plurality of plugs are mounted in at least some of the ports. Each plug has at least three plug management contacts in electrical communication with the at least three electronics unit contacts for the associated port.

In another aspect, a plug is provided. The plug includes a body having first and second opposite walls, first and second opposite sides between the first and second opposite walls, and opposite first and second ends between the first and second walls. The first end has an opening for receiving an electrical cable. The second end has a plurality of metal contacts. The first wall has at least one planar contact pad and a non-volatile memory device, such as an EEPROM, in communication with the at least one planar contact pad.

In some implementations, the first wall includes a planar pad region holding the at least one contact pad and an adjacent stepped region with a riser therebetween. The riser defines a notch holding the NON-VOLATILE MEMORY DEVICE, SUCH AS THE therein.

In some embodiments, the at least one contact pad includes three planar contact pads.

In some implementations, the three contact pads extend substantially a complete width across the first wall between the first and second sides.

In another aspect, a method of installing an electronics unit into a patch panel is provided. The patch panel includes a frame, at least one chassis held by the frame, with the chassis including a plurality of ports adapted to receive plugs. The method includes aligning at least one plug guide extending from the electronics unit next to one of the plurality of ports. The method includes inserting at least one hook extending from the electronics unit into a receiving cavity in the at least one chassis. The method includes laterally moving the electronics unit relative to the at least one chassis to engage the at least one hook. The method includes mounting a faceplate to the frame to lock the electronics unit in place.

The at least one chassis can include a plurality of chassis held by the frame, and the step of inserting may including inserting a plurality of hooks extending from the electronics unit into the receiving cavity of at least some of the chassis in the plurality of chassis.

In some implementations, the step of aligning at least one plug guide includes aligning a plurality of plug guides extending from the electronics unit next to the plurality of ports. The step of laterally moving the electronics unit also includes laterally moving the plurality of plug guides.

The step of aligning at least one plug guide extending from the electronics unit next to one of the plurality of ports can include aligning the at least one plug guide next to a plug operably mounted in one of the plurality of ports.

In some implementations, the step of aligning at least one plug guide extending from the electronics unit next to one of the plurality of ports includes aligning the at least one plug guide next to one of the plurality of ports, which is free of plugs. The method can include after the step of laterally moving the electronics unit, operably mounting a plug into one of the ports.

The step of operably mounting a plug can be after the step of mounting a faceplate.

In another aspect, a method of detecting the presence of a plug in a port of a patch panel is provided. The method includes providing at least three contacts in an electronics unit mounted in the patch panel; and checking whether two of the three contacts are electrically shorted together by mutual contact with a conductive wire. In certain implementations, the method includes checking whether all three contacts are electrically shorted together.

In one implementation, the method can further include inserting a plug having at least three plug management contacts into the port; and while inserting the plug, moving the three contacts in the electronics unit so that the two of the three contacts in the electronics unit are moved out of contact with the conductive wire.

In another aspect, a plug is provided. The plug includes a body having first and second opposite walls, first and second opposite sides between the first and second walls, and opposite first and second ends between the first and second walls. The first end has an opening for receiving an electrical cable. The second end has a plurality of metal contacts. The first wall has at least first and second planar contact pads and a non-volatile memory device in communication with the contact pads.

In one or more embodiments, the first contact pad is adjacent the first side, and the second contact pad is adjacent the second side.

Preferably, the non-volatile memory device is centered between the first and second contact pads.

In example embodiments, the plurality of metal contacts includes eight metal contacts.

In another aspect, a network device is provided. The network device includes a housing and a plurality of ports. Each port has a plurality of signal contacts. Each port is sized to receive a plug having metal contacts for electrical connection with the signal contacts. Each port has a first port management contact and a second port management contact, with the signal contacts in between. The first and second port management contacts are for connecting with the plug management contacts on a plug.

In some implementations, the first and second port management contacts are secured to an electronics unit that is retrofittable onto the network device.

In some embodiments, the first and second port management contacts are held by the housing.

In one or more arrangements, there are no more than two port management contacts.

In example implementations, the network device further includes a plurality of plugs mounted in at least some of the ports. Each plug has first and second plug management contacts in electrical communication with the first port management contact and a second port management contact of the network device.

In another aspect, a method for reading management data from a plug is provided. The method includes inserting a plug having metal contacts into a port of a network device, the plug also having first and second plug management contacts. The first and second plug management contacts are electrically connected with the first and second port management contacts. The plug metal contacts are electrically connected with a plurality of signal contacts in the port. The signal contacts are between the first port management contact and the second port management contact.

In example methods, the step of electrically connecting the first and second plug management contacts includes connecting the first and second plug management contacts to first and second port management contacts secured to an electronics unit that is retrofittable onto the network device.

In example methods, the step of electrically connecting the first and second plug management contacts includes connecting the first and second plug management contacts to first and second port management contacts held by the housing.

A variety of additional inventive aspects will be set forth in the description that follows. The inventive aspects can relate to individual features and to combinations of features.

It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated herein constitute a part of the description, illustrate several aspects of the present disclosure. A brief description of the drawings is as follows.

DETAILED DESCRIPTION

A. Overview of Assembly

Figure 1:
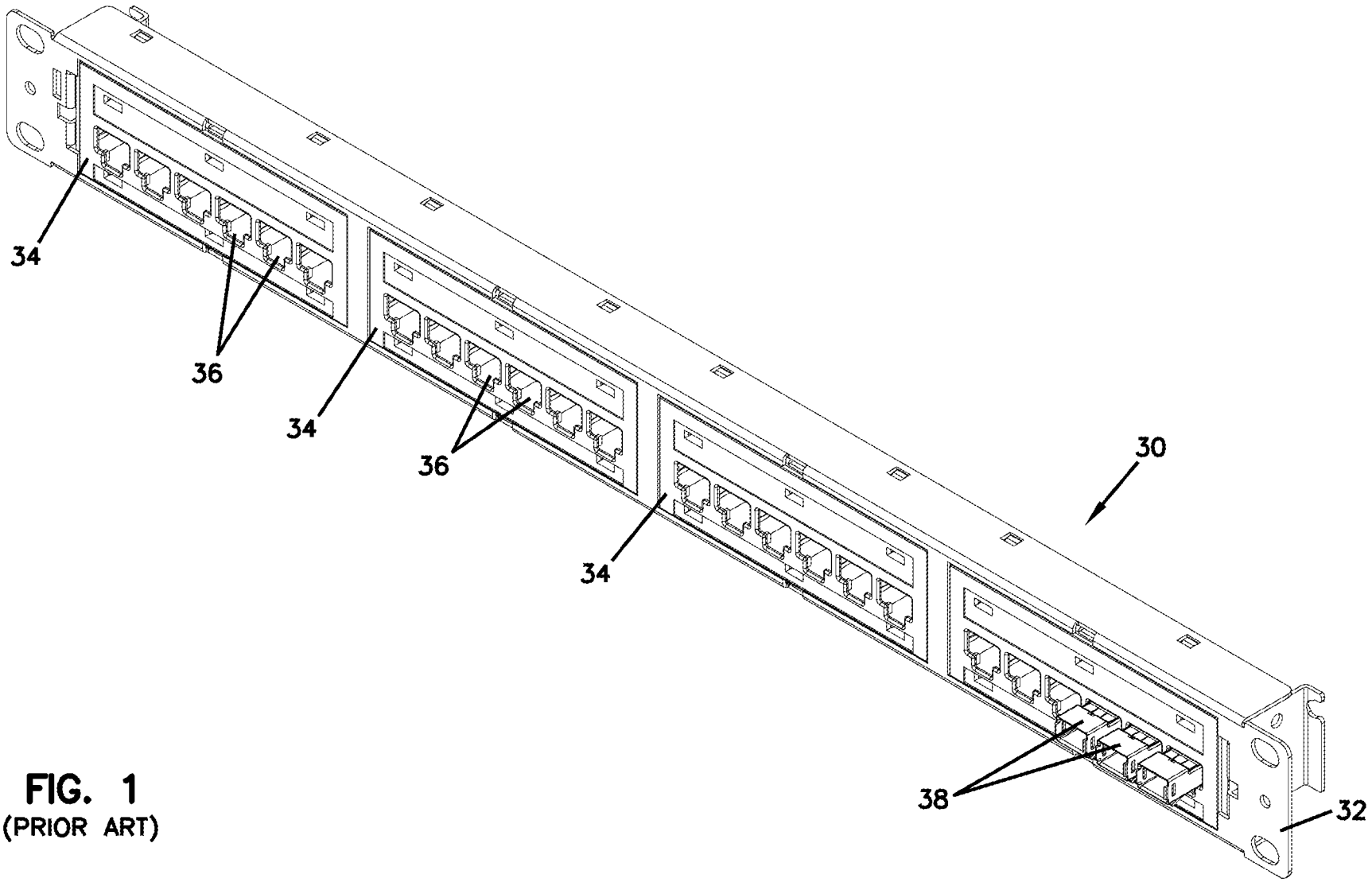
FIG. 1 (PRIOR ART)
FIG. 1 is a perspective view of a prior art patch panel before having an electronics unit installed therein.

FIG. 1 illustrates a perspective view of a prior art patch panel at 30. The patch panel 30 includes a frame 32 that holds one or more chassis 34. The chassis 34 each include a plurality of ports 36. Ports 36 receive jacks or plugs 38. Electrical contact is made between the plugs 38 and contacts within the ports 36. This electrical contact will typically be part of a telecommunications network. The frame 32 will often be secured to a rack, not illustrated.

Figure 2:
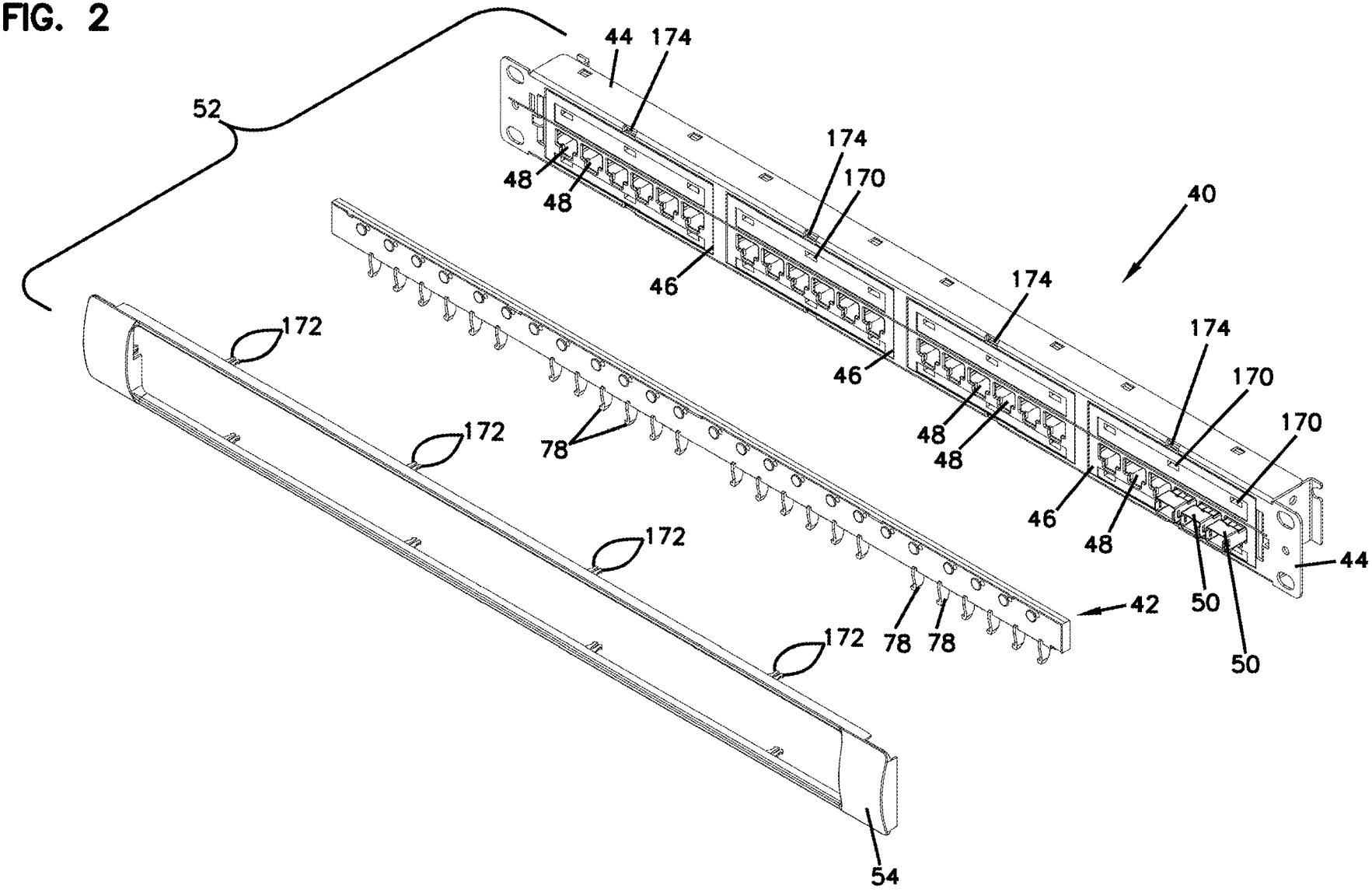
FIG. 2 is an exploded perspective view of a patch panel assembly including the prior art patch panel of FIG. 1 and an electronics unit and faceplate, constructed in accordance with principles of this disclosure.
Figure 3:
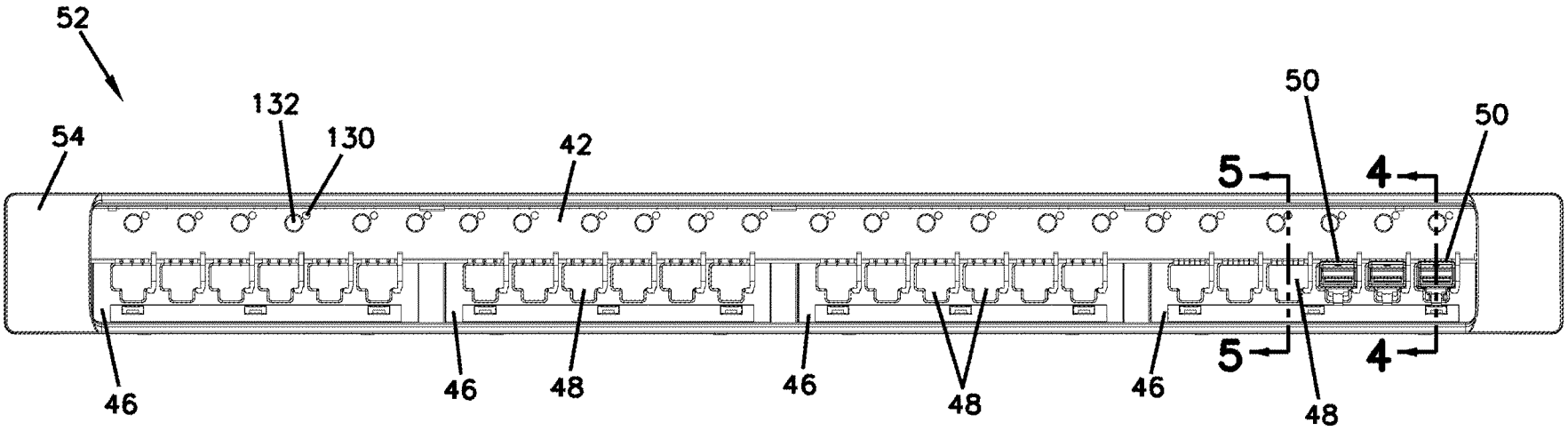
FIG. 3 is a front view of an assembled patch panel having an electronics unit of FIG. 2.

Physical layer management (PLM) can be provided at the patch panel 30 so that physical layer information (PLI) or other data stored electronically on example plugs 50 received at the ports 36 can be provided to a data management network. For example, FIG. 2 illustrates an exploded perspective view of a patch panel 40 having an intelligence, or electronics unit 42 included therewith. The patch panel 40 is the same as the prior art patch panel 30, in that it has frame 44, one or more chassis 46 with ports 48 receiving plugs 50. The electronics unit 42 provides media reading interfaces for reading/writing data from/to the plugs 50, connections to the data management network, and internal circuitry connecting the media reading interfaces to the data management network connections.

The electronics unit 42 can be retrofitted into an existing patch panel, such as patch panel 30 to result in the patch panel 40 having the electronics unit 42. The electronics unit 42 can be fitted into the prior art patch panel 30, while the prior art patch panel 30 is operable and including plugs 38 electrically connected therein. This is discussed further below.

With the electronics unit 42 installed at the patch panel, the patch panel ports 48 can receive either plugs 50 storing electronic data or standard plugs 38. The electronics unit 42 does not interfere with the normal connection of either managed plugs 50 or unmanaged plugs 38. The electronics unit 42 also detects the presence of any plug 38, 50 received at the ports 48, even an unmanaged plug 38. The electronics unit 42 can read electronic data stored on the plugs 50.

In FIG. 2, a patch panel assembly 52 is illustrated and includes the patch panel 40, electronics unit 42, and a faceplate 54. The faceplate 54 mounts to the patch panel 40 and helps to hold the electronics unit 42 in place. This is described further below.

B. Electronics Unit, FIGS. 11-21

Turning now to FIGS. 11-21, one example embodiment of electronics unit 42 is illustrated. FIGS. 11-14 show exploded perspective views of the example electronics unit 42 usable with the patch panel assembly 52 of FIG. 2.

Figure 13:
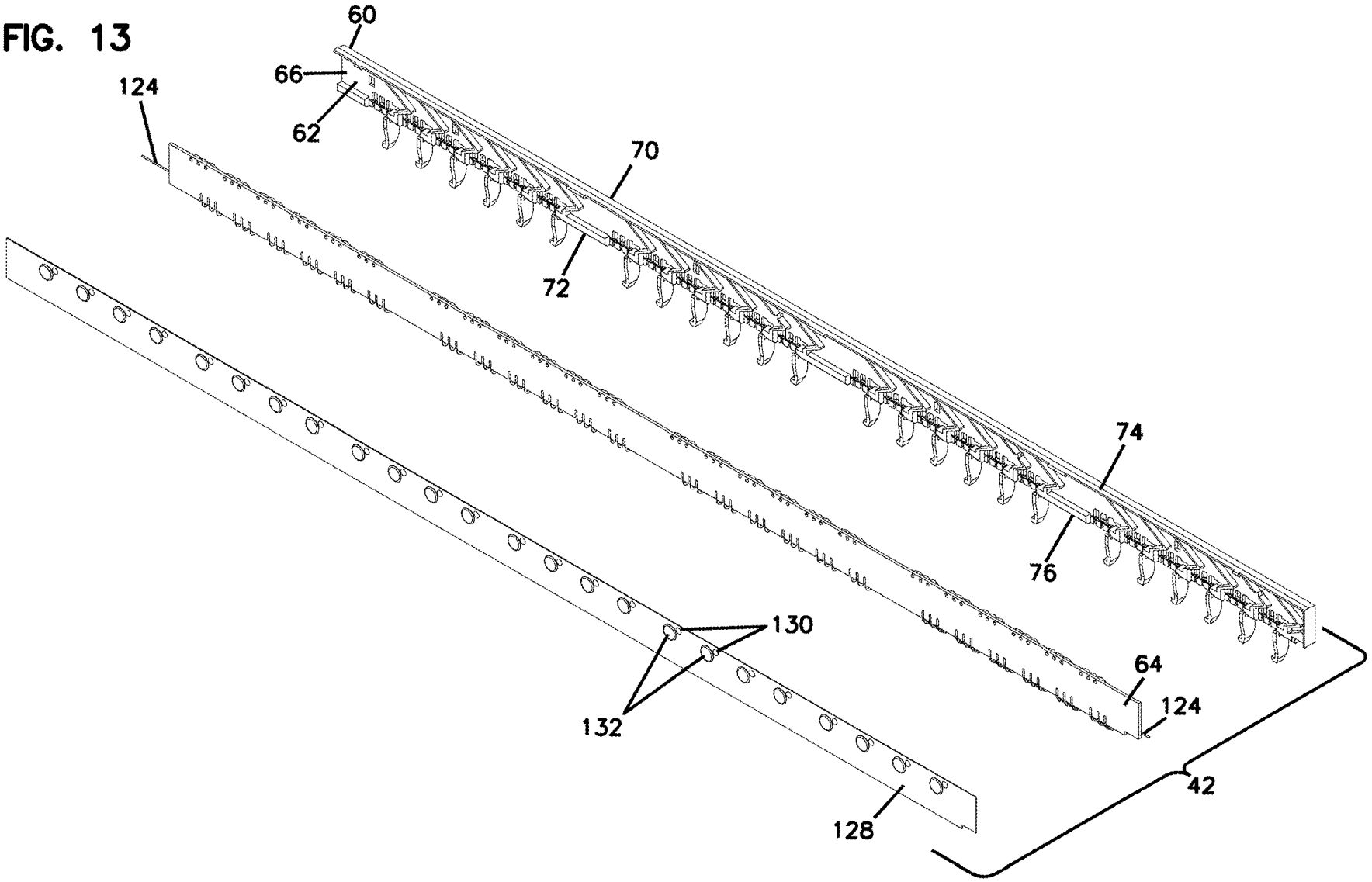
FIG. 13 is an exploded front perspective view of the electronics unit, taken from an opposite view of FIG. 11.
Figure 14:
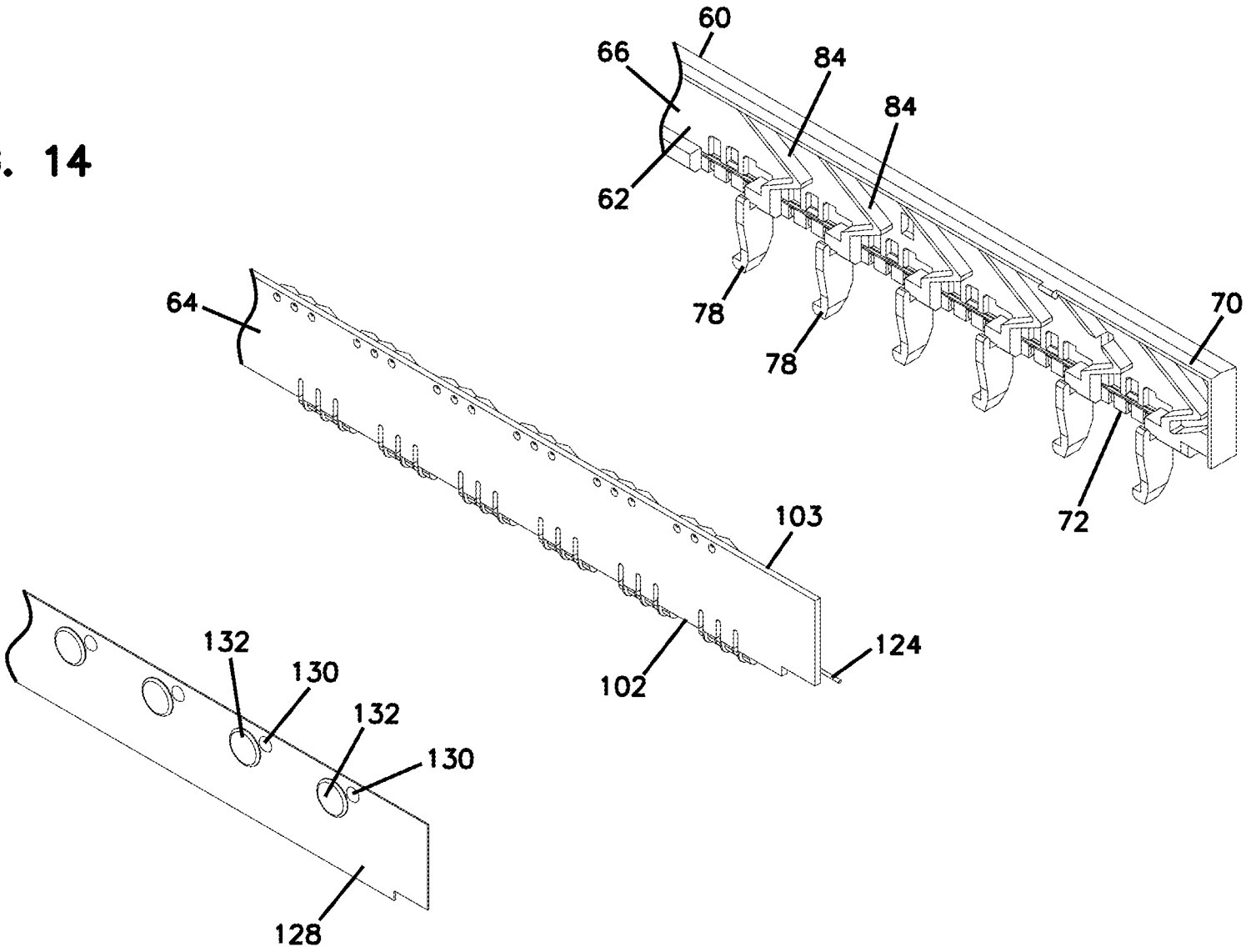
FIG. 14 is an enlarged view of portions of FIG. 13.
Figure 15:
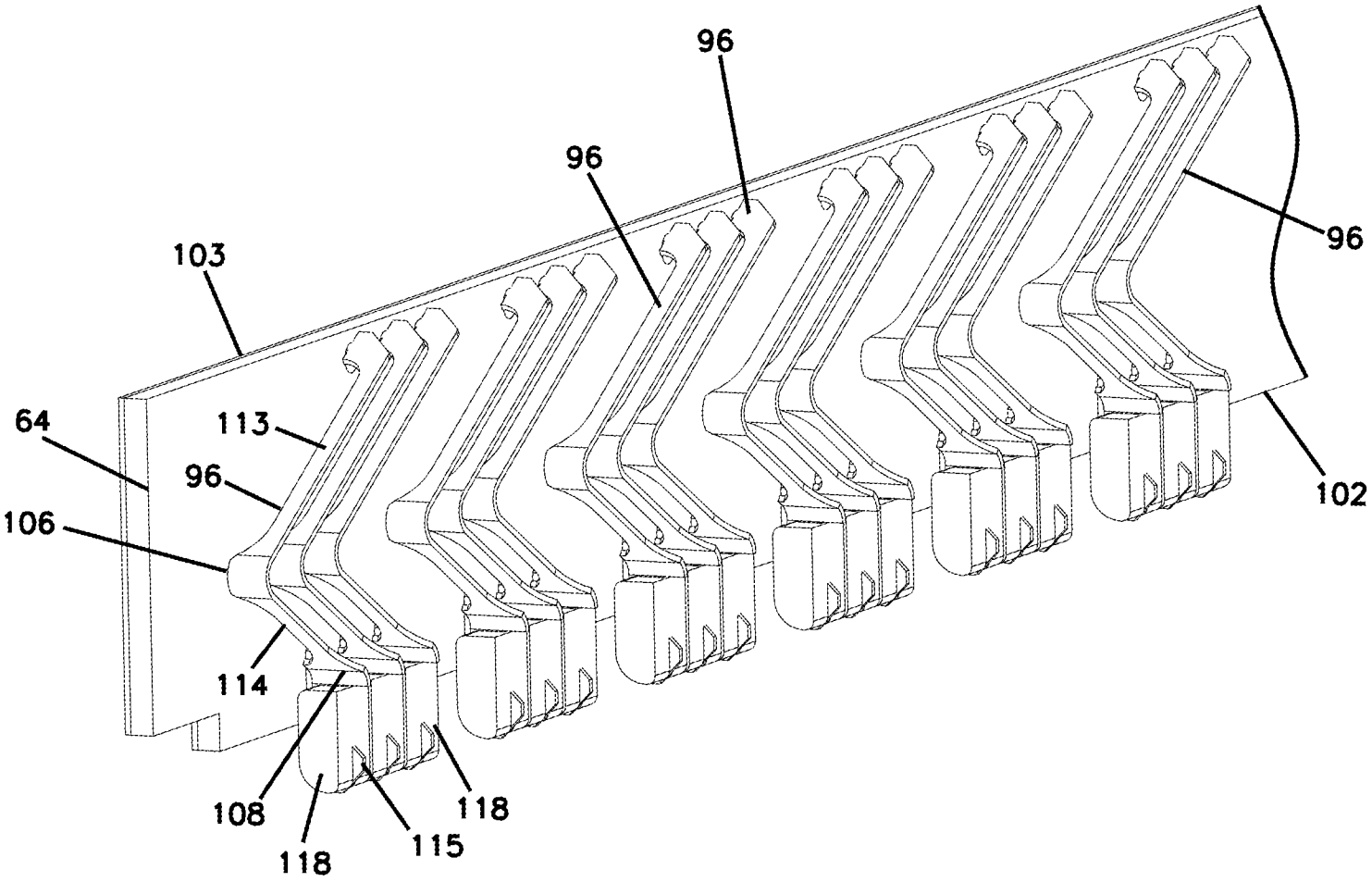
FIG. 15 is a perspective view of a portion of the circuit board depicted in the electronics unit of FIGS. 11-14.
Figure 16:
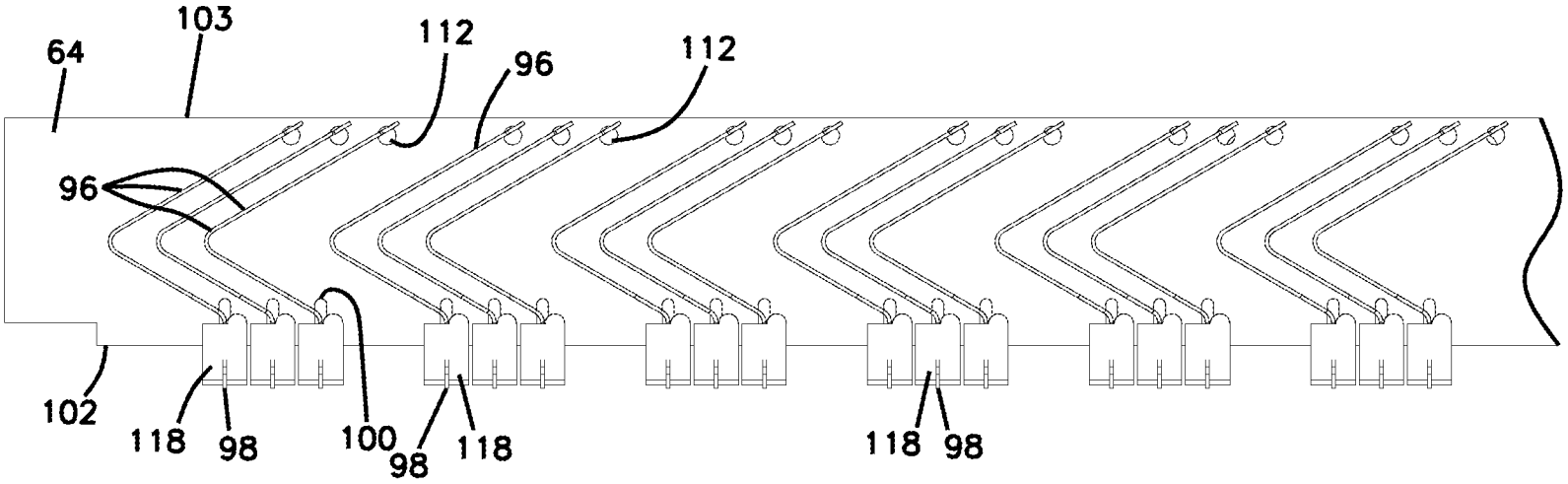
FIG. 16 is a front view of a portion of the circuit board of FIG. 15.

While many embodiments are possible, in the one shown, the electronics unit 42 includes a base 60. The base 60 is generally an elongated plate type member, which is typically a non-metal, such as plastic. The base 60 will typically be made in a single piece, such as by molding. The base 60 includes a holding section 62 (FIGS. 13 and 14). The holding section 62 is for securably holding a circuit board 64.

The base 60 has a first side 66 and an opposite second side 68. The first side 66 defines the holding section 62. The base further has a top edge 70 and a bottom edge 72, with the holding section 62 therebetween. Extending from the top edge 70 is an upper flange 74, while a bottom flange 76 extends from the bottom edge 72. The upper flange 74 and bottom flange 76 help to hold and keep the circuit board 64 in place.

The base 60 further includes a plurality of spaced plug guides 78. In this embodiment, the plug guides 78 extend from the bottom edge 72 of the base 60. The plug guides 78 assist with properly mounting the electronics unit 42 into the patch panel 40. The plug guides 78 also assist with achieving proper mounting of the plugs 50 to make the correct electrical contact between the electronics unit 42 and the plugs 50. This is discussed in further detail below, especially in connection with FIGS. 9 and 10.

Each of the plug guides 78 projects or extends from the bottom edge 72 to extend in a direction away from the remaining portion of the base 60. Each plug guide 78 includes an extending arm 80 and a finger 82 at an end remote from the base 60. The finger 82 is generally perpendicular to the arm 80.

In certain implementations, the base 60 may further include a plurality of ribs 84. The ribs 84 extend along the first side 66 between the top edge 70 and bottom edge 72 within the holding section 62. The ribs 84, in this embodiment, are generally V-shaped and help to strengthen or stiffen the base 60. Many embodiments are possible.

Figure 11:
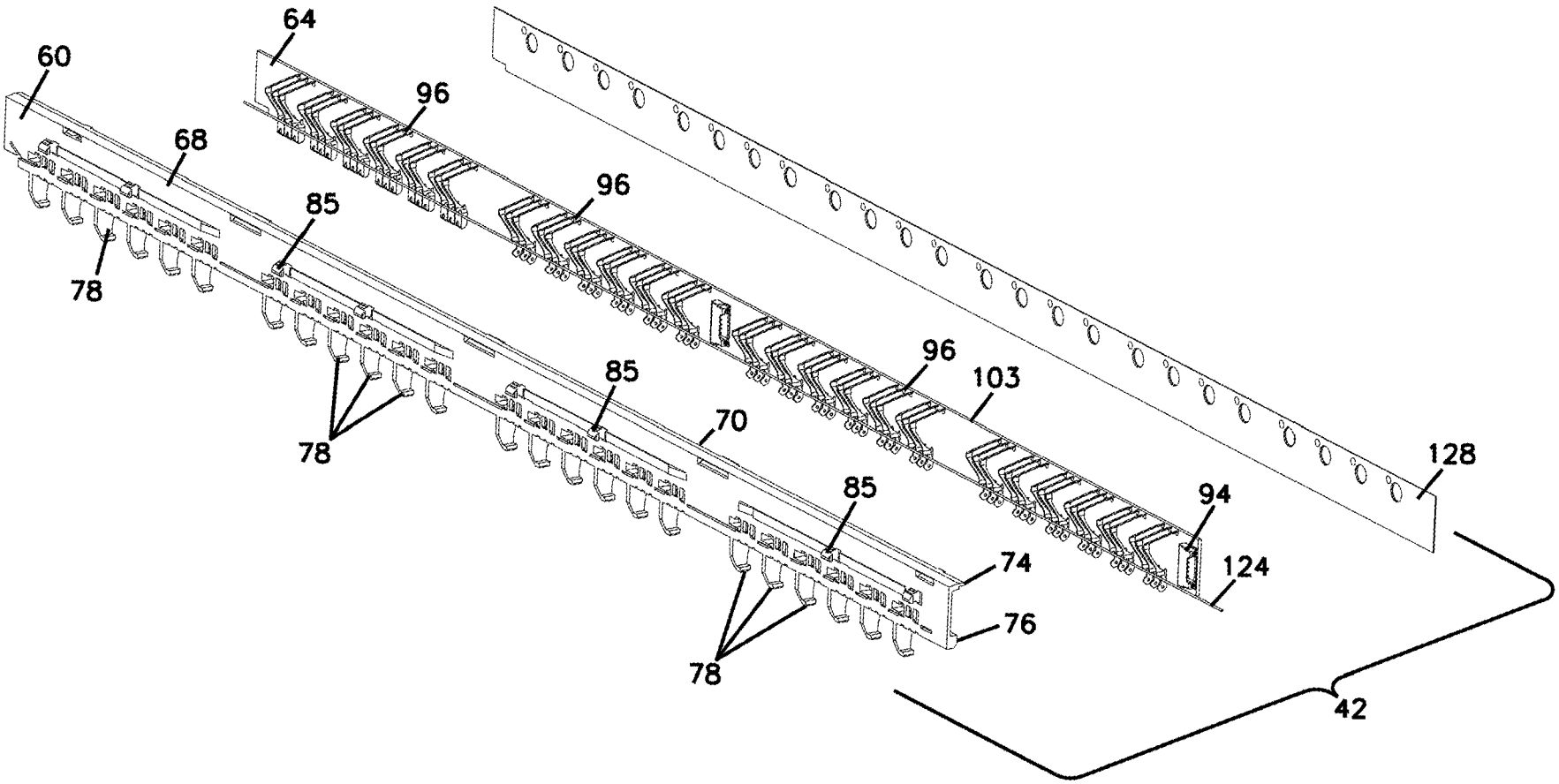
FIG. 11 is an exploded rear perspective view of the electronics unit alone that is in the patch panel assembly of FIG. 2.

The base 60 includes a plurality of hooks 85 (FIG. 11). The hooks 85 are illustrated as extending from the second side 68 of the base 60. The hooks 85 are spaced along the longitudinal length of the base 60 and help to connect the electronics unit 42 with the chassis 46, as described further below.

Figure 19:
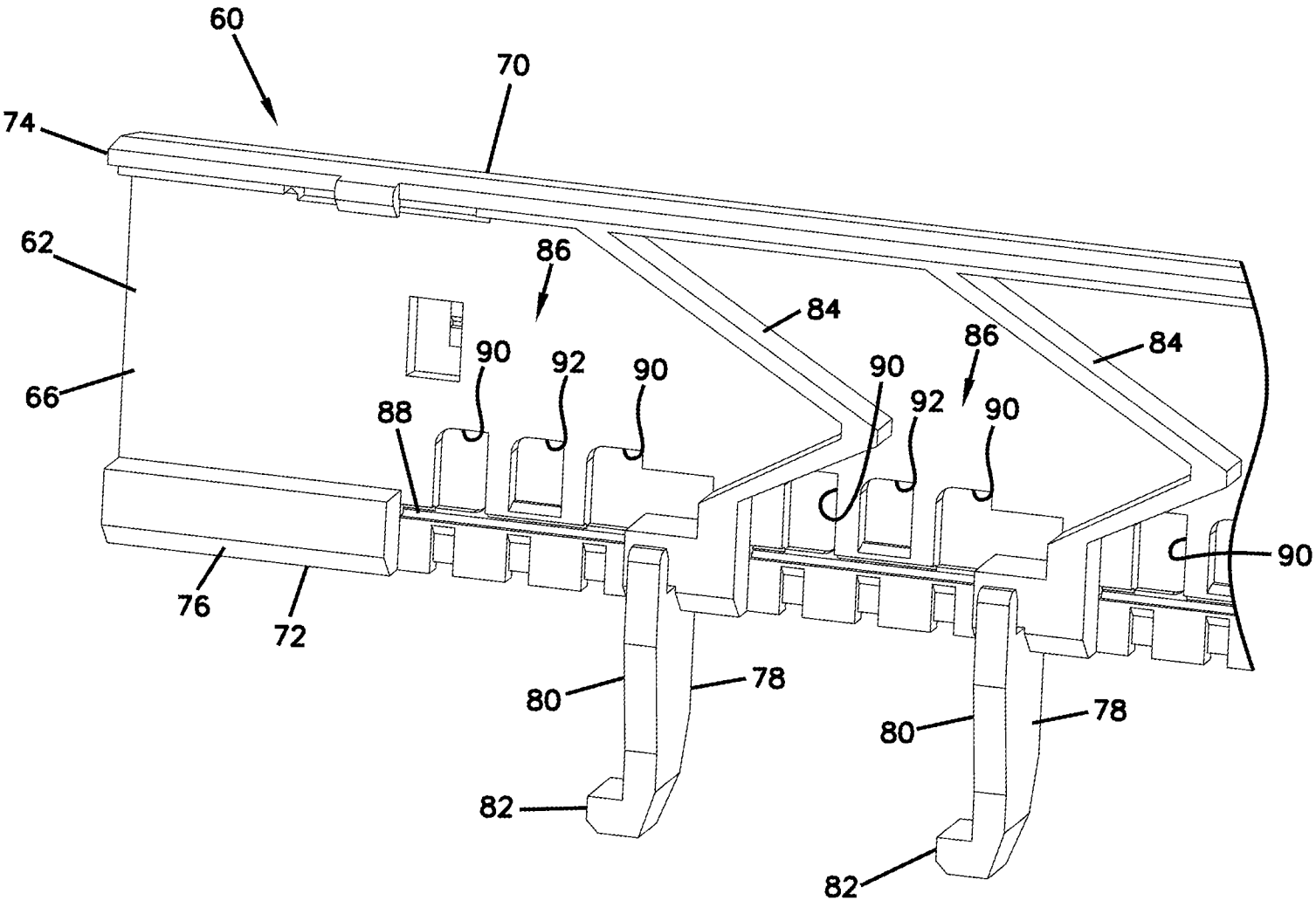
FIG. 19 is a perspective view of a portion of a base used as part of the electronics unit shown in FIGS. 11-14.

In reference now to FIG. 19, the base 60 further includes a plurality of openings or windows 86. The windows 86 are through openings extending through the holding section 62. A channel 88 is defined by the base 60 and extends longitudinally along the length of the base 60 adjacent to the windows 86.

Still in reference to FIG. 19, the windows 86 include a first plurality of windows 90 and a second plurality of windows 92. The first plurality of windows 90 are open to the channel 88, while the second plurality of windows 92 are blocked from the channel 88.

As will be described further below, the windows 86 and channel 88 are part of a system and method for detecting the presence of a plug 50 in connection with electronics unit 42. This is described further below. In this embodiment, for each plug guide 78, there are two of the first windows 90 and one of the second windows 92. The second window 92 is in between the first windows 90. Each set of three windows 86 will correspond to one port 48.

In reference again to FIGS. 11-14, the electronics unit 42, as mentioned previously, includes circuit board 64. The circuit board 64 has at least one connector 94. In the embodiment shown in FIG. 11, the connector 94 is located at an axial end of the circuit board 64. Alternative positions are possible.

The at least one connector 94 connects the electronics unit 42 to a management system, which is part of the management network. For example, one or more management cables can be routed to a rack or other structure at which the patch panel 30 is mounted. In certain examples, the management cable can be branched out into multiple management pigtails. One of the management pigtails can be routed to the patch panel 30 and plugged into the at least one connector 94 to connect the electronics unit 42 to the management network.

The circuit board 64 further includes a plurality of electronics unit contacts 96. The contacts 96 are attached to the circuit board 64, such as by soldering. In certain examples, each of the contacts 96 includes a pin 110 (FIG. 18) that goes through a hole 112 in the circuit board 64 to allow for securing the contact 96, such as by soldering. Alternate ways of securing the contacts 96 to the remaining portion of the circuit board 64 are possible.

Attention is directed to FIGS. 15-18. Each of the contacts 96 has a contact area or connection point 98 that is movable relative to a remaining portion of the circuit board 64. The connection points 98 of the contacts 96 will be movable relative to a remaining portion of the circuit board 64 in response to contact with one of the plugs 38, 50 that has been inserted into one of the ports 48 in the patch panel 40.

The electronics unit 42 is configured to limit and guide the direction of movement of the connection points 98 relative to the remaining portion of the circuit board 64. For example, in certain implementations, the circuit board 64 includes a plurality of slots 100 (see FIGS. 17 and 18). Each slot 100 holds and allows a range of motion for each of the connection points 98. Each slot 100 permits axial motion of each connection point 98 and prevents lateral motion of each connection point 98. This allows the connection points 98 to move in a direction from a bottom edge 102 of the circuit board 64 in a direction toward a top edge 103 of the circuit board 64. Typically, as will be explained below, this axial motion is in response to one of the plugs 38, 50 making contact.

Figure 17:
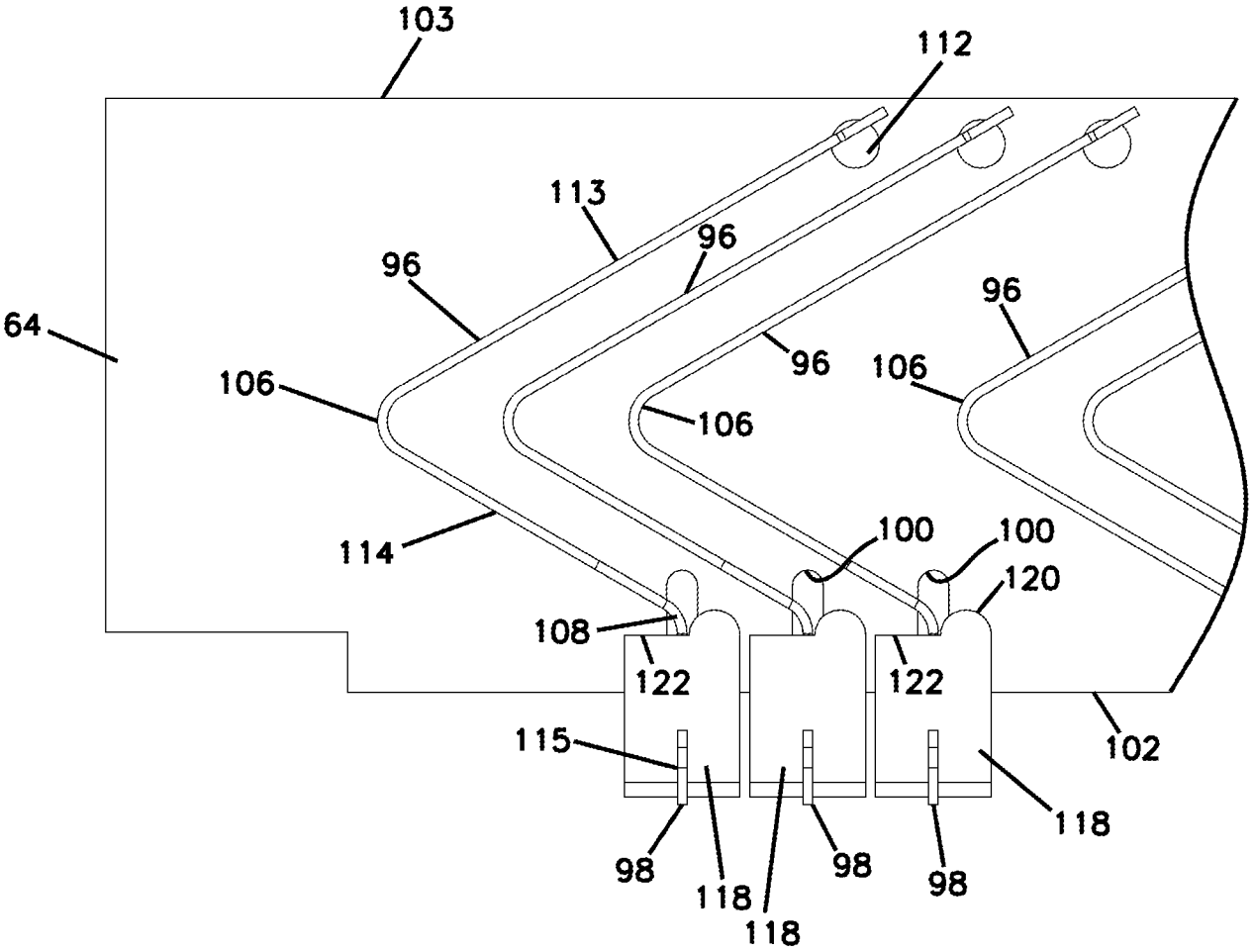
FIG. 17 is an enlarged view of a portion of FIG. 16.
Figure 18:
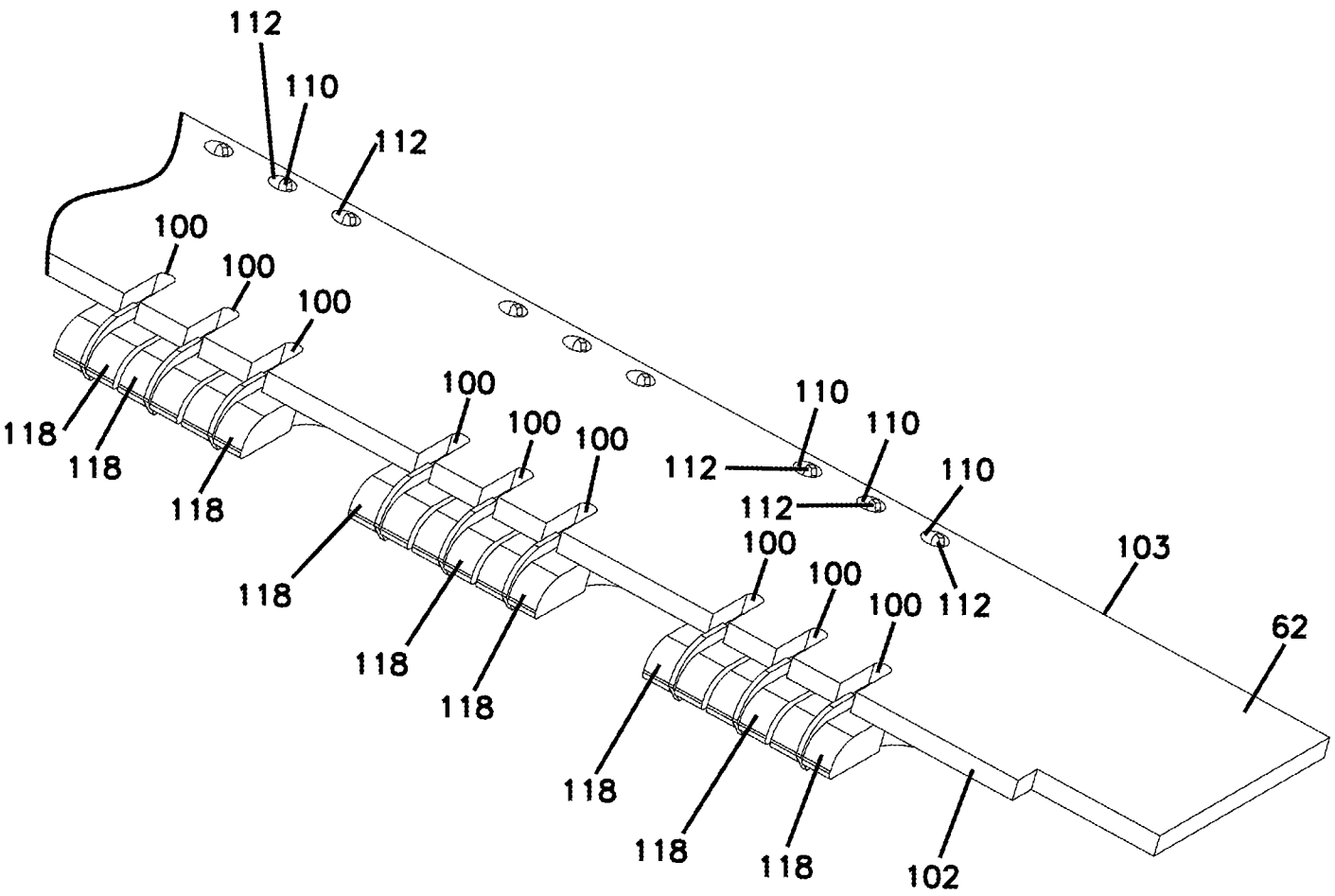
FIG. 18 is another perspective view of the circuit board of FIGS. 15-17, taken from the opposite side of FIG. 15.

Each electronics unit contact 96 includes a flexible portion disposed between the connection point 98 and the pin 110. The flexible portion may include one or more bends that allow the connection point 98 to move relative to the pin 110. In this embodiment, each of the electronics unit contacts 96 is a stamped metal piece 104 having at least a first bend 106 and a second bend 108. In FIG. 17, it can be seen how, in this embodiment, each contact 96 extends from where the pin 110 is secured in the hole 112 along a first extension 113. The first extension 113 is angled at greater than 0° and less than 90° relative to the top edge 103. From the first extension 113, the contact 96 goes through the first bend 106 to a second extension 114. The second extension 114 is angled relative to the first extension 113 at an angle greater than 0° and less than 90°, for example about 20-60°. From the second extension 114, the contact 96 goes through the second bend 108. To lead to a third extension 115. The third extension 115 is generally about perpendicular to the bottom edge 102 and extends below the bottom edge 102 and remote from a remaining portion of the circuit board 64. The shape of the contacts 96 is helpful in allowing for robust and flexible contacts.

Each contact 96 includes an overmolded plastic piece 118. The overmolded piece 118 helps to keep each of the contacts 96 separated from an adjacent contact. In certain examples, the overmolded piece 118 is sized to extend between the circuit board 64 and the base 60 to inhibit movement of the connection point 98 in a forward-rearward direction (i.e., along a plug insertion axis). The overmolded piece 118 also includes a projecting bump 120 (FIG. 17). The bump 120 extends or projects from an upper edge 122 (FIG. 17) of the overmolded piece 118 to prevent short circuits between adjacent contacts 96. When the connection point 98 of a contact 96 moves axially within the slot 100 relative to a remaining portion of the circuit board 64, the bump 120 of the respective overmolded piece 118 may make physical contact with an adjacent contact 96 and prevent electrical connection or contact between the adjacent electronics unit contacts 96.

Figure 12:
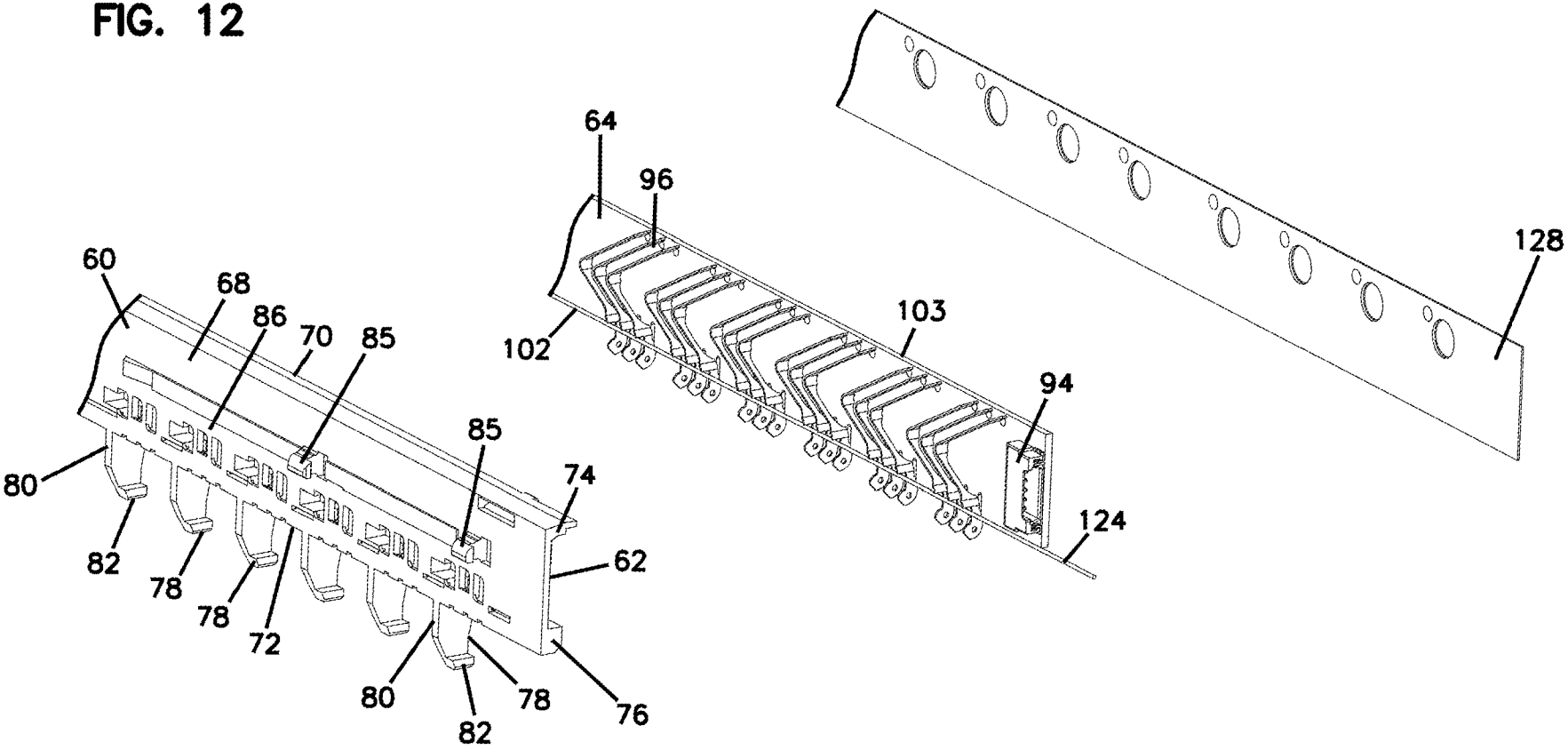
FIG. 12 is an enlarged view of portions of the electronics unit of FIG. 11.

The circuit board 64 further includes a conductive wire 124 (FIG. 12). The conductive wire 124 is held by the channel 88 in the base 60, when the circuit board 64 is assembled and operably held within the base 60. This can be seen in FIG. 21 and in hidden lines in FIG. 20. The conductive wire 124 is part of the system and method for detecting the presence of plug 50, as further described herein.

Figure 20:
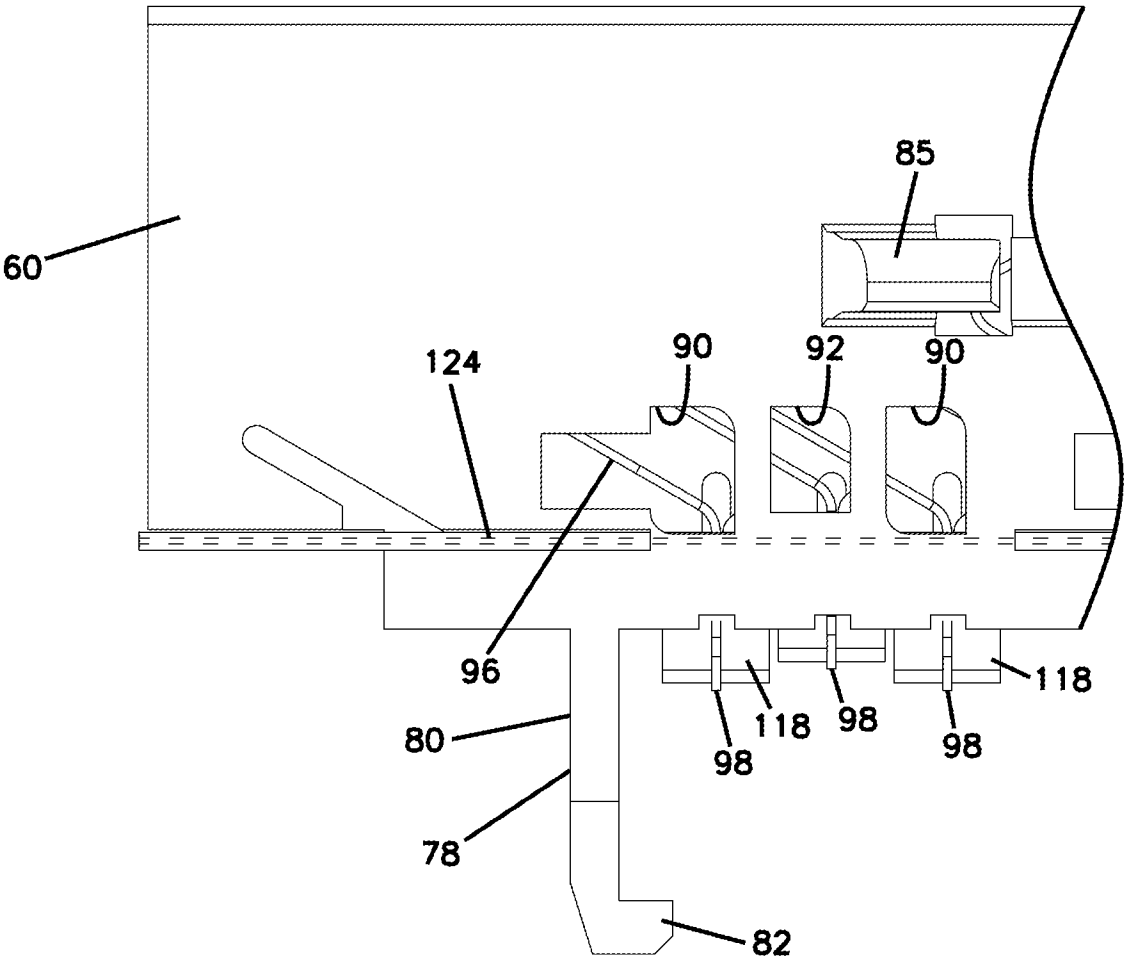
FIG. 20 is a front view of a portion of the base and circuit board attached together.

FIG. 20 shows the circuit board 64 and contacts 96 as they would appear when the electronics unit 42 is assembled and there is no plug 50 present. When the circuit board 64 is held by the base 60, each of the contacts 96 is in communication with one of the windows 86 in the base. See FIGS. 19 and 20. The windows 86 pre-stress or hold the connection points 98 of the contacts 96 in the position shown in FIG. 21 when the electronics unit 42 is assembled. Accordingly, the contacts 96 are pre-stressed before a plug 38, 50 is inserted at the port 48. This pre-stress creates a downward force on the connection points 98 of the contacts 96 to enhance physical contact between the connection points 98 and respective plugs 38, 50.

In this example, the contacts 96 in communication with the first plurality of windows 90 are in electrical contact with the conductive wire 124 at window contact region 97 when there is no plug 50 inserted in the port 48 associated with those windows. The contacts 96 in communication with the second plurality of windows 92 at window contact region 99 are blocked from contact with the conductive wire 124. An electrical current or voltage is applied to the wire 124. Accordingly, any contacts 96 in physical contact with the conductive wire 124 are shorted together.

Figure 21:
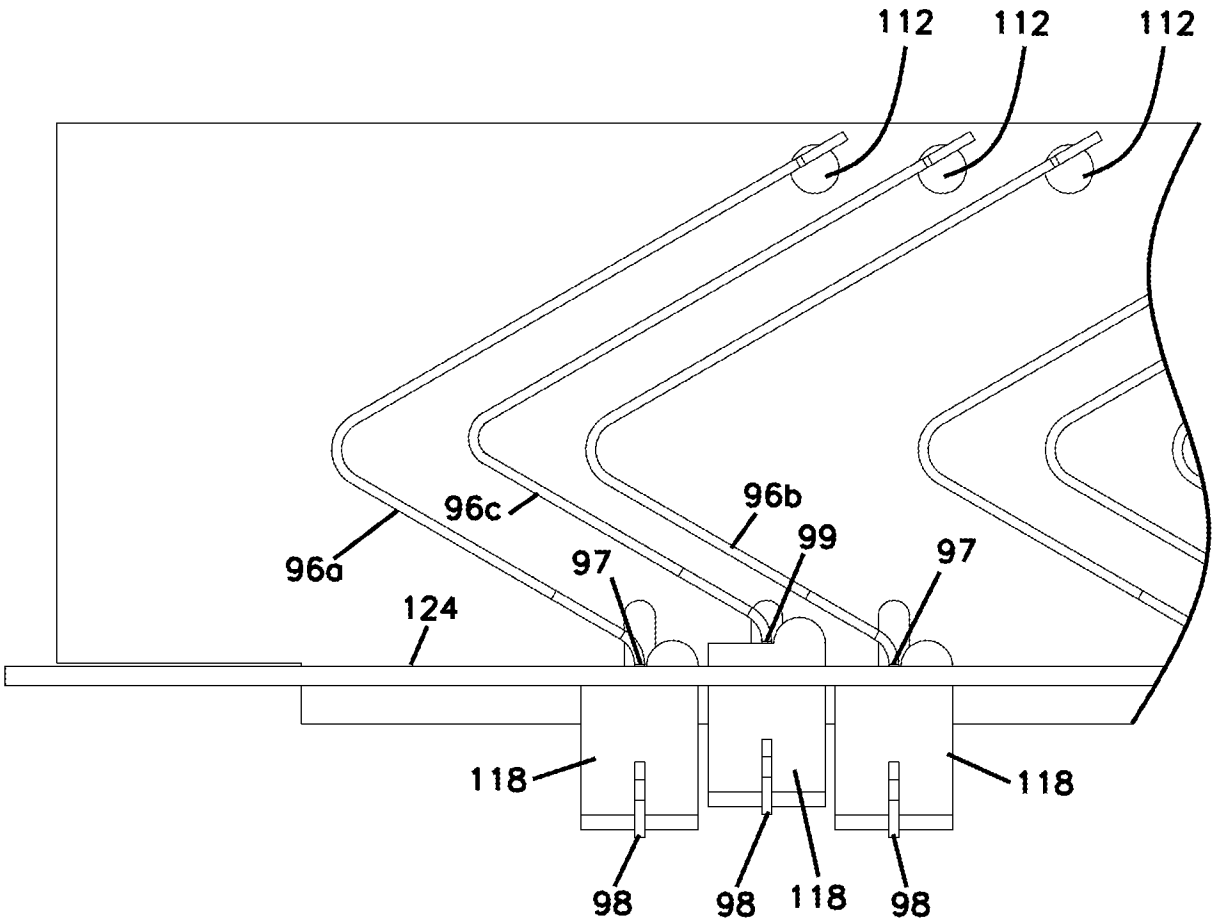
FIG. 21 is a front view of the circuit board, similar to the view of FIG. 17, but showing how the contacts would be in position when the circuit board is attached to the base.

FIG. 21 shows the contacts 96 and circuit board 64 of FIG. 20 with the base 60 removed for ease in viewing. In FIG. 21, the circuit board 64 is shown with contacts 96*a* and 96*b* in electrical communication and physical contact with the conductive wire 124. The window contact region 99 of the second contact 96*c* is spaced from the conductive wire 124 (e.g., by the window 92).

Figure 22:
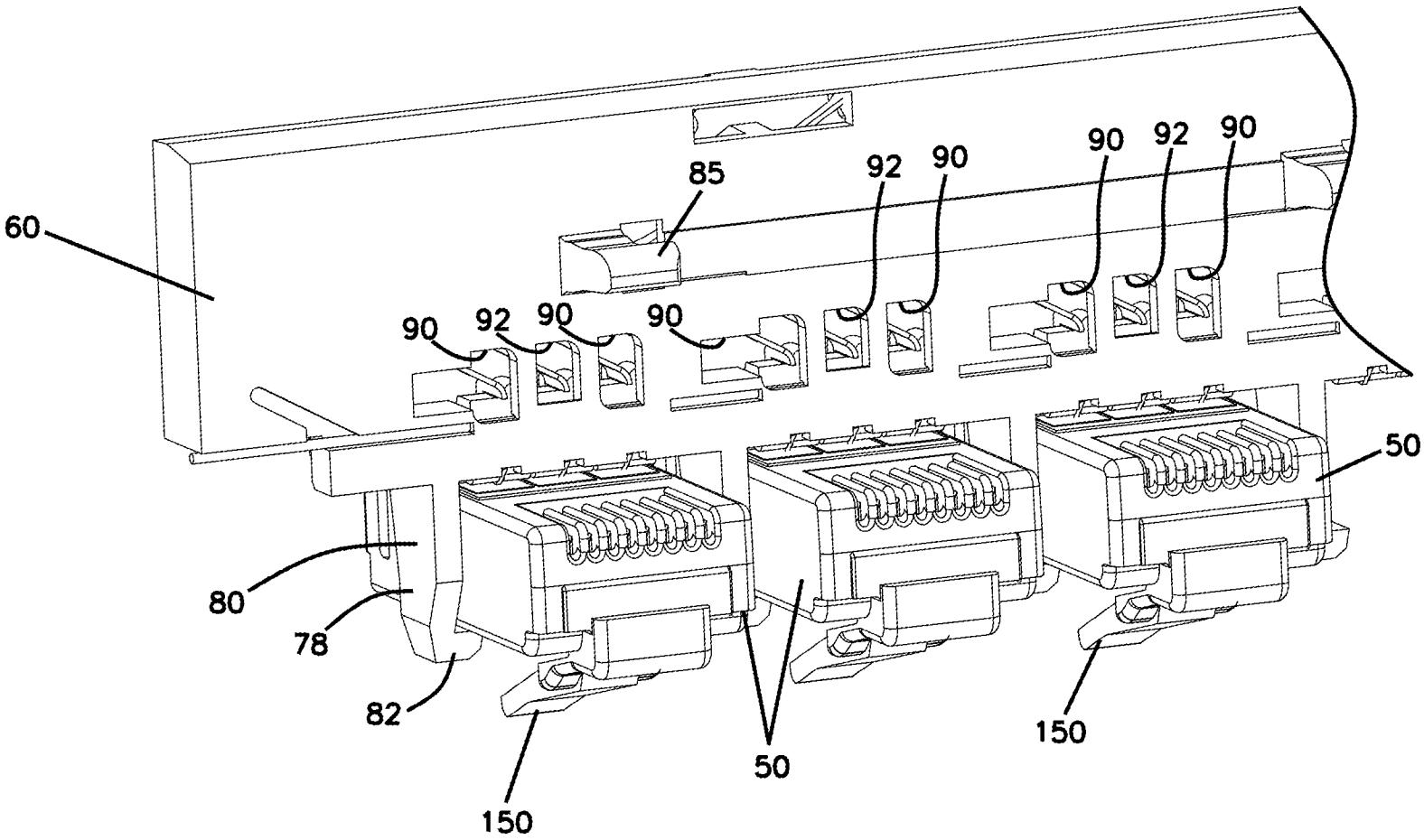
FIG. 22 is a rear perspective view showing plugs in electrical contact with the electronics unit.

FIG. 22 shows plugs 50 positioned relative to the electronics unit 42 as they would appear when disposed in ports 48 in the patch panel 40. The plugs 50 make contact with the electronics unit contacts 96 and move the connection points 98 axially upwardly, which moves the window contact region 97 of the contacts 96*a* and 96*b* out of contact with the conductive wire 124. When the contacts 96*a* and 96*b* are in electrical communication or contact with the conductive wire 124, the contacts 96*a*, 96*b* are shorted together. The management system detects the contact shorting and determines that no plug is present at the contacts 96*a*, 96*b*. When the contacts 96*a*, 96*b* are out of electrical contact with the conductive wire 124, the lack of electrical short indicates to the management system that there is a plug 50 present at the contacts 96*a*, 96*b*.

In certain implementations, a shielded plug can be received at the patch panel 40. The shielded plug includes a metal jacket surrounding the plug. Accordingly, all three contacts in the port would touch the metal jacket of the plug when the plug is received at the port 48. The metal jacket would short the contacts together. To avoid a false negative reading, the management system is configured to detect whether all three contacts are shorted together or whether only the outer two contacts are shorted together. If all three contacts are shorted together, then the management system determines that a shielded plug is present at a port 48. If only the outer two contacts are shorted together, then the management system determines that no plug has been received at the port 48.

Figure 23:
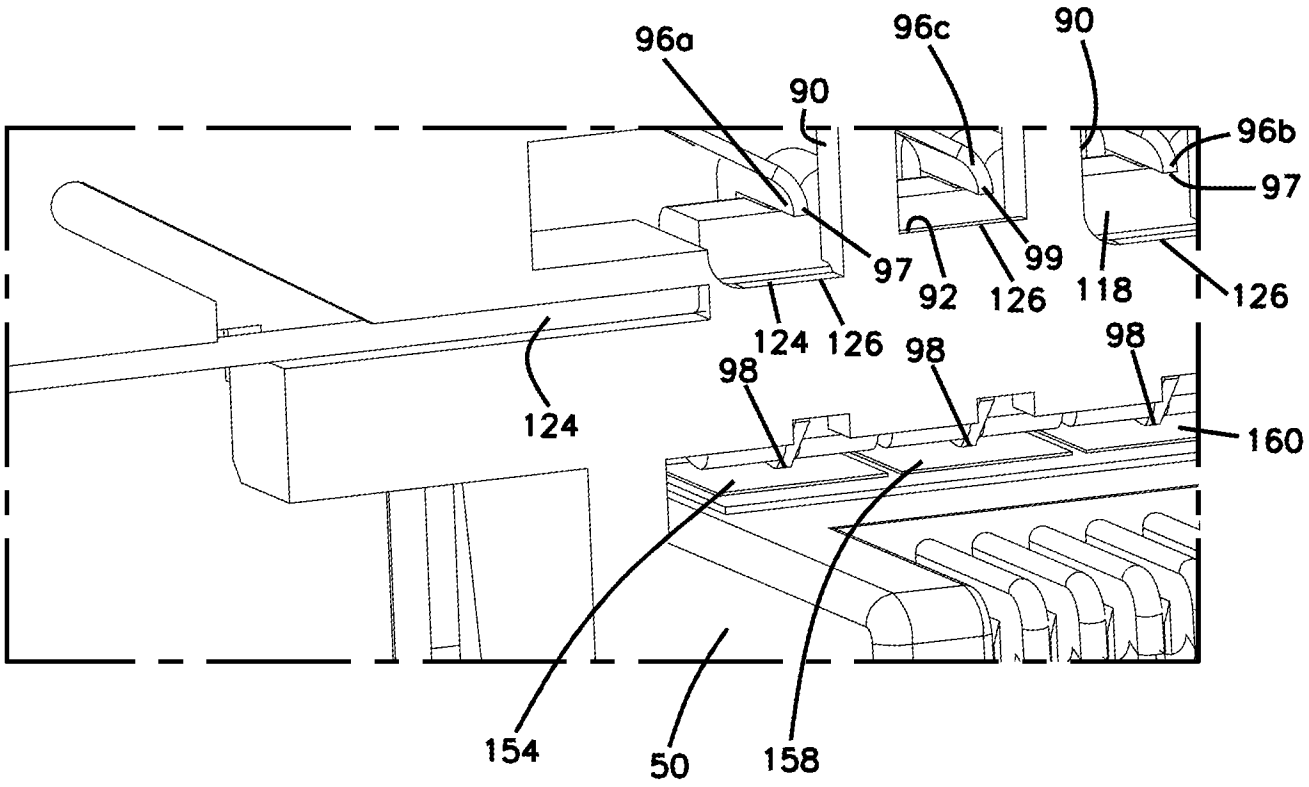
FIG. 23 is an enlarged perspective view of a portion of FIG. 22, depicting the plug contacts in electrical communication with the electronics units contacts.

FIG. 23 illustrates in greater detail how the contacts 96*a*, 96*b* are moved out physical connection with the conductive wire 124. The connection point 98 of each of the contacts 96*a*, 96*b*, and 96*c* is moved upward axially away from a bottom edge 126 of each of the windows 90, 92 when the plug 50 is inserted in the port and contact is made between the plug 50 and the electronics unit contacts 96.

The electronics unit 42 further includes a cover plate 128. The cover plate 128 is secured to the base 60 with the circuit board 64 therebetween. The cover plate 128 can define apertures or window through which one or more visual indicators (e.g., LEDs) 130 are visible. In certain examples, each port 48 of the patch panel 40 has a respective visual indicator 130 positioned thereat. The LEDs 130 are in electrical communication with the circuit board 64. The cover plate 128 may further include one or more buttons 132 or apertures through which buttons 132 carried by the circuit board 64 may extend. The buttons 132 are in electrical communication with the circuit board 64. In some examples, each port 48 may have a corresponding button 132. In other examples, each button 132 may be associated with a plurality of ports 48.

The LEDs 130 and buttons 132 help to provide communication and information to a technician servicing the patch panel assembly 52. In certain implementations, the management system is configured so that one of the visual indicators 130 can be activated to indicate the respective port 48. For example, the visual indicator 130 can be activated to indicate to a technician into which port 48 the next plug should be inserted or otherwise indicating a circuit track for an associated port 48 in the patch panel 40. In another example, a technician can push a button 132 above a particular port receiving a plug 38, 50 of a cable to request the management system to activate a light indicator 130 associated with another port 48 receiving a plug at the opposite end of the cable.

Figure 24:
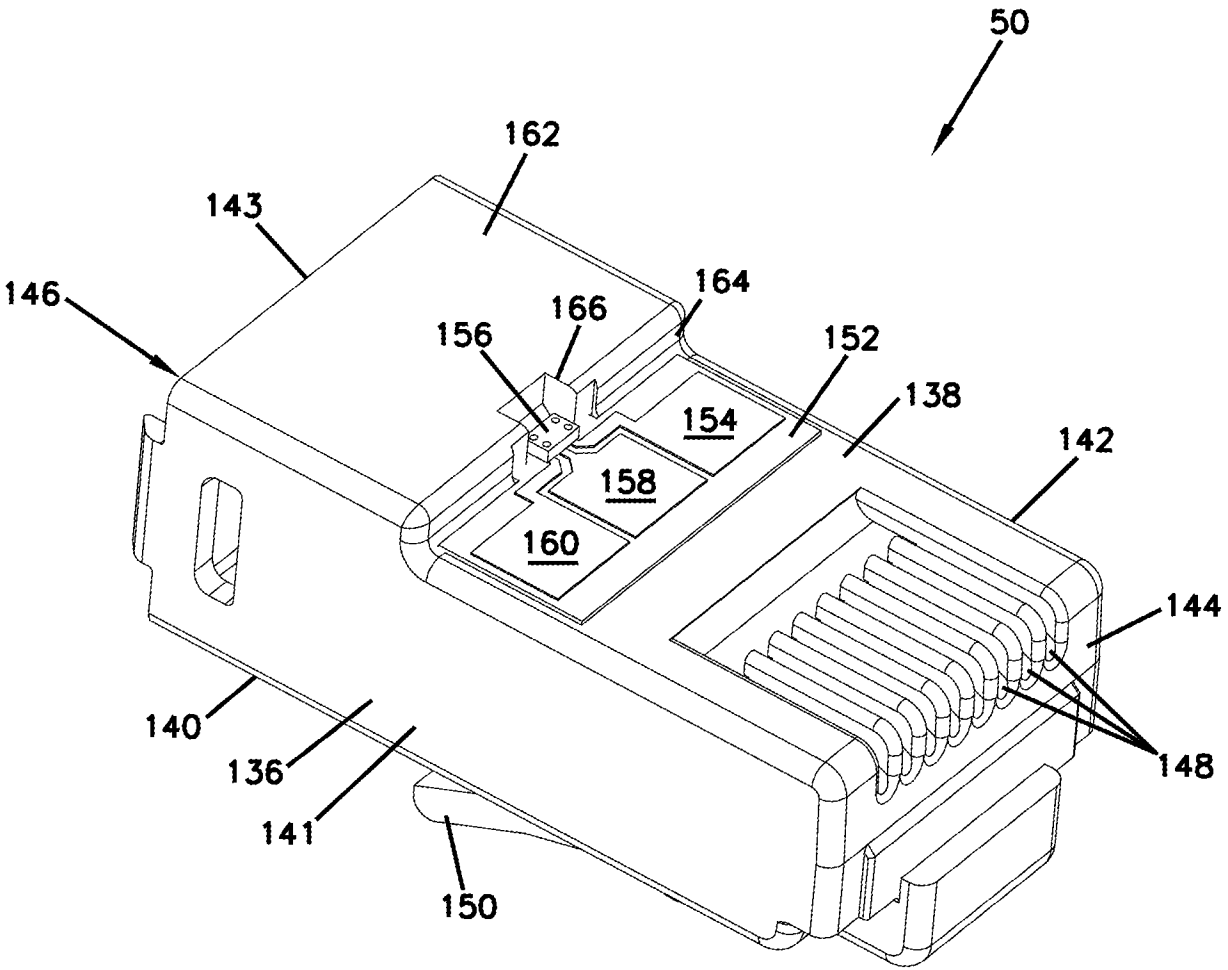
FIG. 24 is a perspective view of an embodiment of a plug, constructed in accordance with principles of this disclosure.
Figure 25:
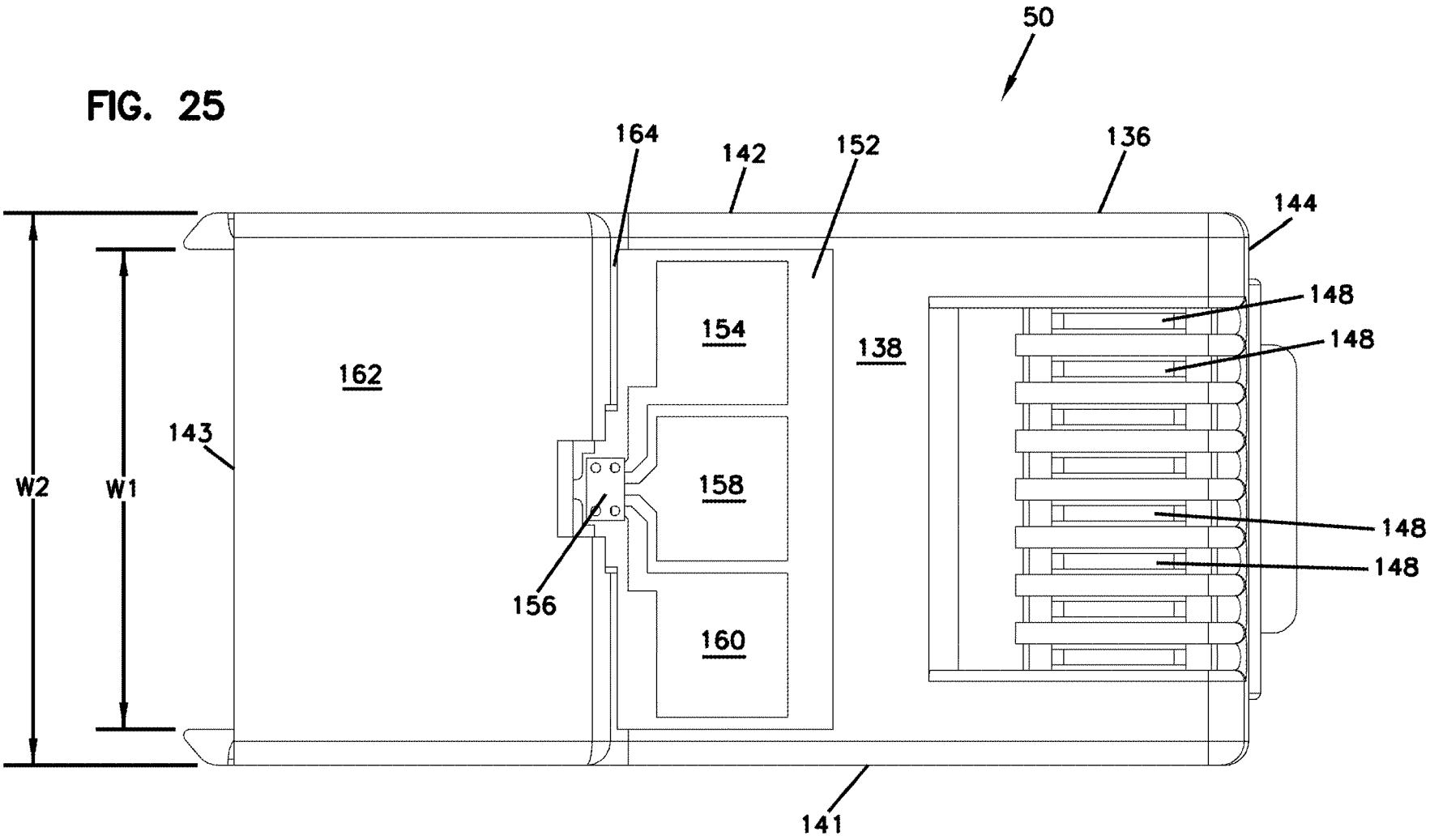
FIG. 25 is a top plan view of the plug of FIG. 24.

C. Example Plug, FIGS. 24-25

Before describing the patch panel assembly 52 in more detail, an example embodiment of plug 50 usable with the patch panel assembly 52 is now described.

The plug 50 includes a body 136 that carries at least one primary signal contact 148 and at least one management contact. In certain implementations, the plug body 50 carries a plurality of primary signal contacts 148 and a plurality of management contacts. The primary signal contacts 148 are in communication with media segments (conductive wires, optical fibers, etc.) of the cable terminated by the plug 50. Accordingly, signals carried over the cable are received at and transmitted through the primary signal contacts 148. The management contacts are isolated from the primary signal contacts 148 and from the media segments of the cable.

The plug body 136 has a first wall 138 and an opposite second wall 140. In the embodiment shown in FIG. 24, the first wall corresponds to a top wall, while the second wall 140 corresponds to a bottom wall.

The plug body 136 further includes first and second opposite sides 141, 142 between the first and second walls 138, 140. The body 136 also has opposite first and second ends 143, 144 between the first and second walls 138, 140.

The first end 143 has an opening 146. The opening 146 is for receiving an electrical cable, such as a twisted pair cable as known in the art. The second end 144 holds the primary signal contacts 148. The primary signal contacts 148 are for providing an electrical connection between the cable and contacts in the ports 48 of the patch panel assembly 52.

The plug 50 also includes a locking latch finger 150 that will releasably lock the plug 50 into the port 48, as is well known in the art.

The first wall 138 includes a planar pad region 152. The planar pad region 152 holds at least one planar contact pad 154 (plug management contact 154). The plug 50 includes a memory at which data (e.g., physical layer information) can be stored and a processor configured to access the memory. In the example shown, the processor and memory are provided by a non-volatile memory device, such as an EEPROM 156, in communication with the at least one planar contact pad 154.

In the example embodiment, both the contact pad 154 and EEPROM 156 are on the upper or first wall 138. In this manner, when the plug 50 is inserted into one of the ports 48, the contact pad 154 will be in a position to make electrical contact with the electronics unit contacts 96 of the electronics unit 42.

In certain implementations, multiple contact pads can be disposed on the plug 50. In certain examples, each contact pad is configured to contact the connection point 98 of a respective one of the electronics unit contacts 96 when the plug 50 is received at a port 48 of the patch panel 40. In general, the plug 50 has the same number of contact pads as the electronics unit 42 has contacts 96 per port 48. In various examples, the plug 50 can have two contact pads, three contact pads, four contact pads, etc. Many embodiments are possible, and in this embodiment, the at least one contact pad 154 includes three contact pads (plug management contacts) at 154, 158, and 160.

In certain implementations, the contact pads 154, 158, 160 are aligned in a row along a width of the plug body 136. In examples, the contact pads 154, 158, 160 extend across a width W1 (FIG. 25), which is a majority of a width W2 (FIG. 25) of the plug body 136. This helps to ensure good contact with the electronics unit contacts 96, when the plug 50 is inserted into port 48. In the example shown, the three contact pads 154, 158, 160 extend substantially a complete width across the first wall 138 between the first and second sides 141, 142. In another example, the contact pads 154, 158, 160 extend a full width of the plug body 136. In other examples, the contact pads 154, 158, 160 are staggered on the plug body 136.

While many embodiments are possible, in the one shown, adjacent to the planar pad region 152, which holds the contact pads 154, 158, 160, is a stepped region 162. The stepped region 162 also forms a portion of the first wall 138. In between the stepped region 162 and the planar pad region 152 is a riser 164. In certain examples, the riser 164 defines a notch 166 therein. The notch 166 is located approximately in the middle between first side 141 and second side 142. The notch 166 holds the EEPROM 156 therein. In this embodiment, the notch 166 helps to protect the EEPROM 156. In other embodiments, the EEPROM 156 is located forward of the riser 164 and no notch is needed. However, in embodiments that do use the notch 166, advantages are achieved because of the way the notch 166 protects the EEPROM 156.

D. Example Patch Panel Assembly and Methods, FIGS. 2-9

In reference again to FIG. 2, the patch panel assembly 52 includes frame 44, one or more chassis 46 held by the frame 44, and electronics unit 42 held by the chassis 46. Each chassis 46 holds one or more jack modules or other plug sockets to define ports 48. Plugs 50 may be removably mounted into the ports 48 in the chassis 46 to provide electrical contact between the plug management contacts 154,158, 160 of the plug 50 and the electronics unit contacts 96. Faceplate 54 is mounted to the chassis 46, which locks the electronics unit 42 to the chassis 46. The electronics unit 42 is retrofittable into the patch panel 40, as described below.

Figure 8:
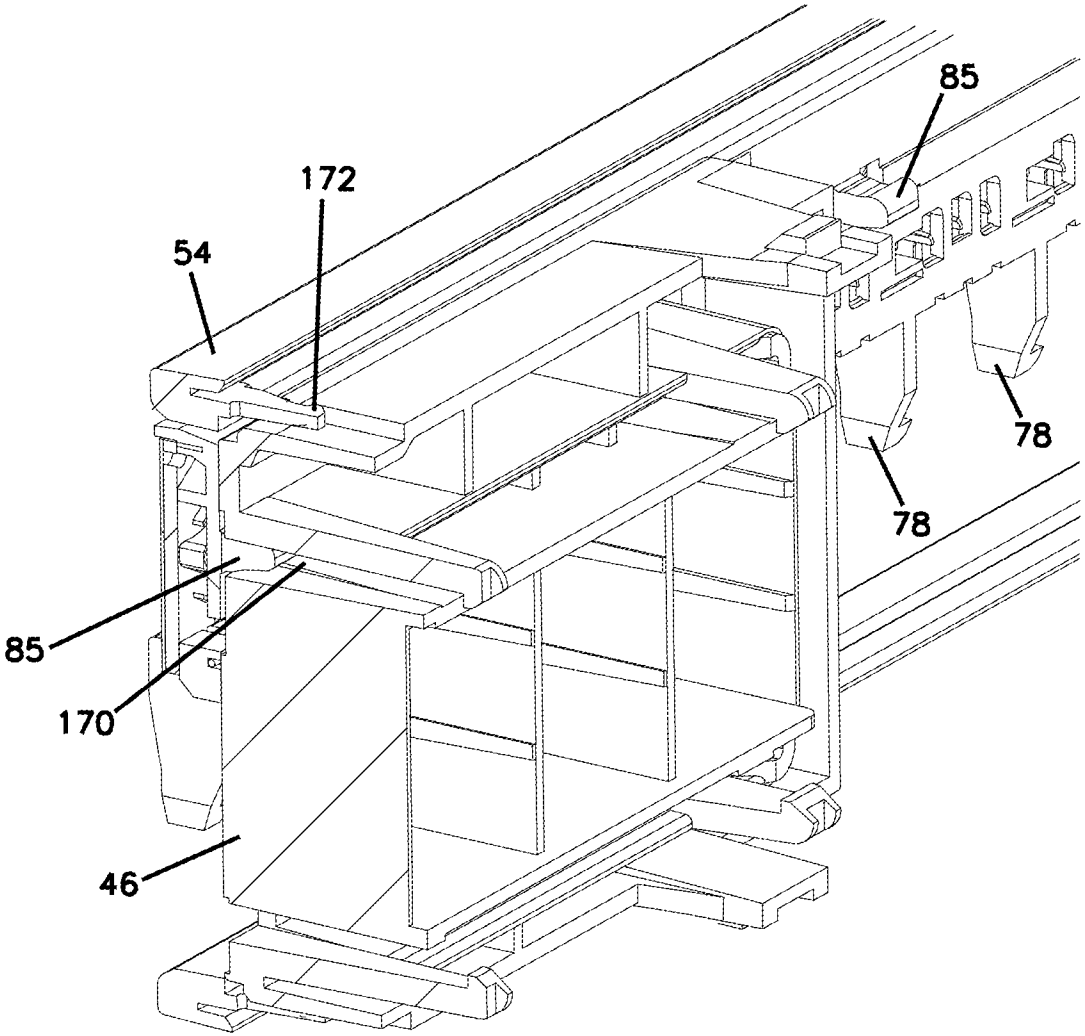
FIG. 8 is an enlarged view of portion A of FIG. 7.

As mentioned previously, the electronics unit 42 includes a plurality of hooks 85 (FIGS. 8, 11, and 12) extending therefrom. The chassis 46 includes a receiving cavity 170 (FIG. 8). The hooks 85 will extend into the receiving cavity 170. The electronics unit 42 can then be moved laterally relative to the chassis 46 and frame 44 to engage the hooks 85 with the chassis 46 and lock it into place. The plug guides 78 of the electronics unit 42 help to properly mount or retrofit the electronics unit 42 in place in the patch panel 40, as described in connection with FIGS. 9 and 10.

Figure 9:
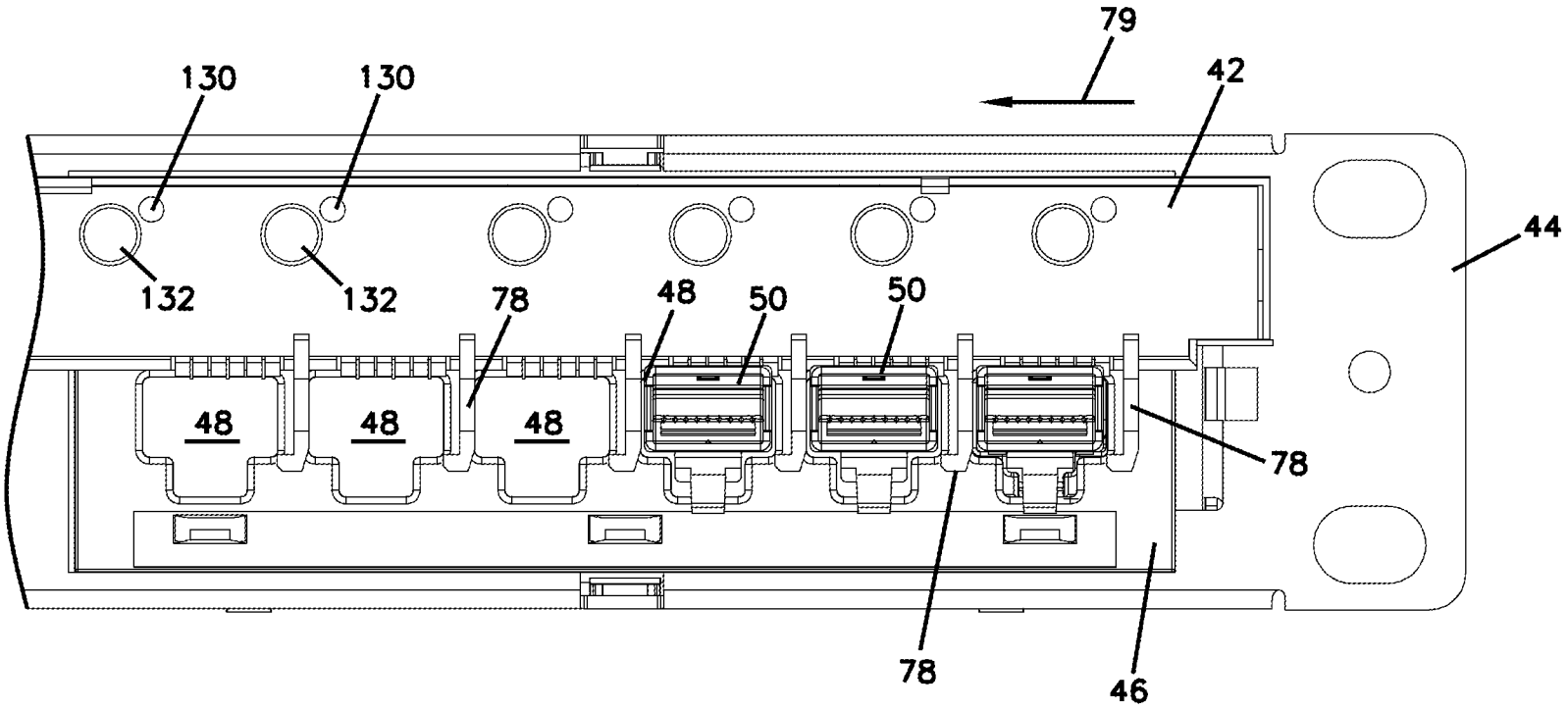
FIG. 9 is an enlarged front view of a portion of the patch panel assembly of FIG. 3 and depicting a first step of installing the electronics unit into the patch panel.
Figure 10:
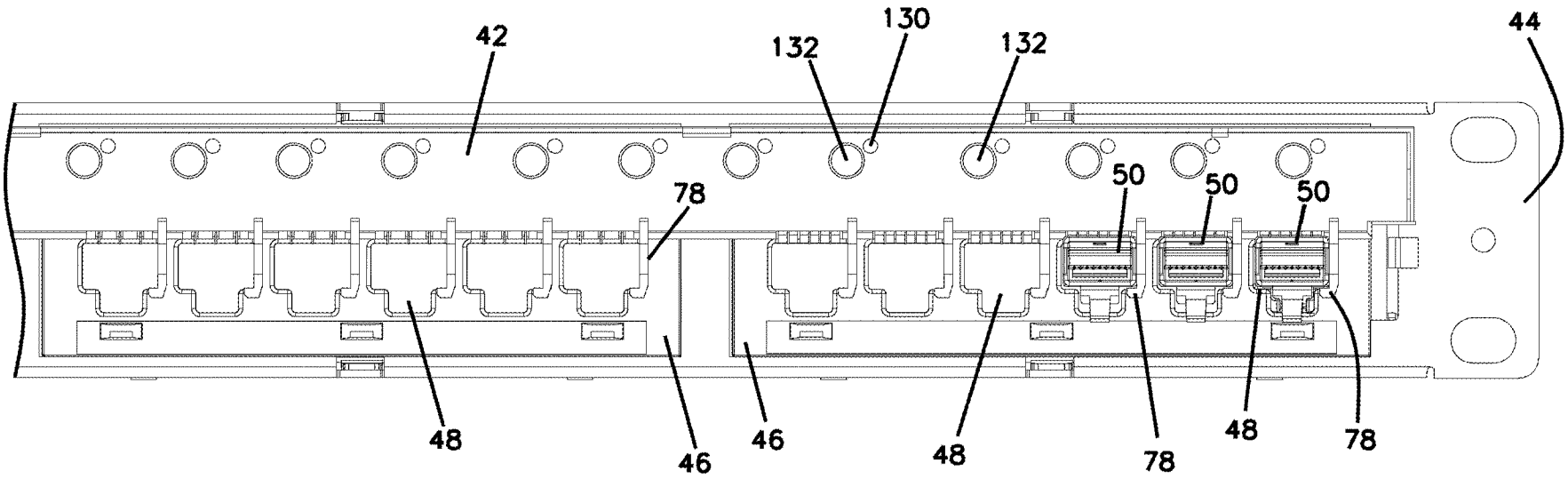
FIG. 10 is a front view of the patch panel assembly of FIG. 9 and showing a second step of installing the electronics unit into the patch panel.

Attention is directed to FIGS. 9 and 10. When installing the electronics unit 42 into the patch panel 40, the faceplate 54 is removed. The electronics unit 42 can be oriented onto the patch panel 40, whether or not there are plugs 50 already installed in the ports 48. FIGS. 9 and 10 illustrate examples where some ports 48 are empty, and some ports 48 have plugs 50 installed therein. The plug guides 78 enhance alignment of the plugs 38, 50 with the ports 48 during installation of the plugs 38, 50. Further, the plug guides 78 are useful to ensure that installation of the electronics unit 42 does not damage the electronics unit contacts 96, the plug management contact pads 154, 158, 160, or other parts of the plugs 50.

To install the electronics unit 42, the electronics unit is positioned in front of the frame 44 so that the hooks 85 align with receiving cavities 170 (FIG. 6) of the chassis 46. The plug guides 78 are aligned to be next to the ports 48, such that there is one plug guide 78 next to (in the embodiment of FIG. 9, to the right of) each port 48. The electronics unit 42 is pushed towards the frame 44 until the hooks 85 extending from the electronics unit 42 are inserted into the receiving cavities 170 of the chassis 46. The plug guides 78 would be as shown in FIG. 9, spaced laterally next to the ports 48. Next, the electronics unit 42 is slid or moved laterally relative in a direction of arrow 79 to the chassis 46 to engage the hook 85 with the chassis 46. The result is as shown in FIG. 10, which shows the plug guides 78 next to and against plugs 50 (if a plug 50 is already in the port 48) or immediately next to an edge of the port 48, if there is no plug 50 already inserted.

The plug guides 78 inhibit a user from initially positioning the electronics unit 42 too far to one side of the plug 50 so that the electronics unit contacts 96 are offset from the plug 50. As noted above, the connection points 98 of the contacts 96 are biased downwardly to press against the plug contact pads 155, 158, 160. If the electronics unit 42 were to be positioned too far to the side, then the subsequent lateral movement of the electronics unit 42 might cause the electronics unit contacts 96 to hit the side of the plug 50, thereby bending or otherwise damaging the electronics unit contacts 96. The plug guides 78 are positioned so that positioning the plug guides 78 between existing plugs 50 aligns the electronics unit 42 sufficiently with any existing plugs 50 so that electronics unit contacts 96 are initially disposed in alignment with the plugs 50. Accordingly, the connection points 98 of the contacts ride over the plugs 50 as intended during normal plug insertion 50 instead of hitting a side of the plug during lateral movement of the electronics unit 42.

In FIG. 22, it can be seen how when the plug 50 has been installed relative to the plug guide 78, the finger 82 will rest below to help support the plug 50. The plug guides 78 help to both properly mount the electronics unit 42 into the patch panel 40, as well as help to orient and properly receive plugs 50 into the ports 48 after the electronics unit 42 has been installed.

After the electronics unit 42 has been laterally moved relative to the chassis 46 to engage the hooks 85, the faceplate 54 is mounted to the frame 44 through engagement between extending latch hooks 172 projecting from a rear portion of the faceplate 54 and hook openings 174 in the frame 44.

In use, the patch panel assembly 52 will include a plurality of chassis 46 having ports 48. Plugs 50 can be selectively mounted or unmounted from the ports 48 in the chassis. When the plugs 50 are mounted in the ports 48, the plug management contacts 154, 158, 160 are in electrical communication with the electronics unit contacts 96.

Figure 4:
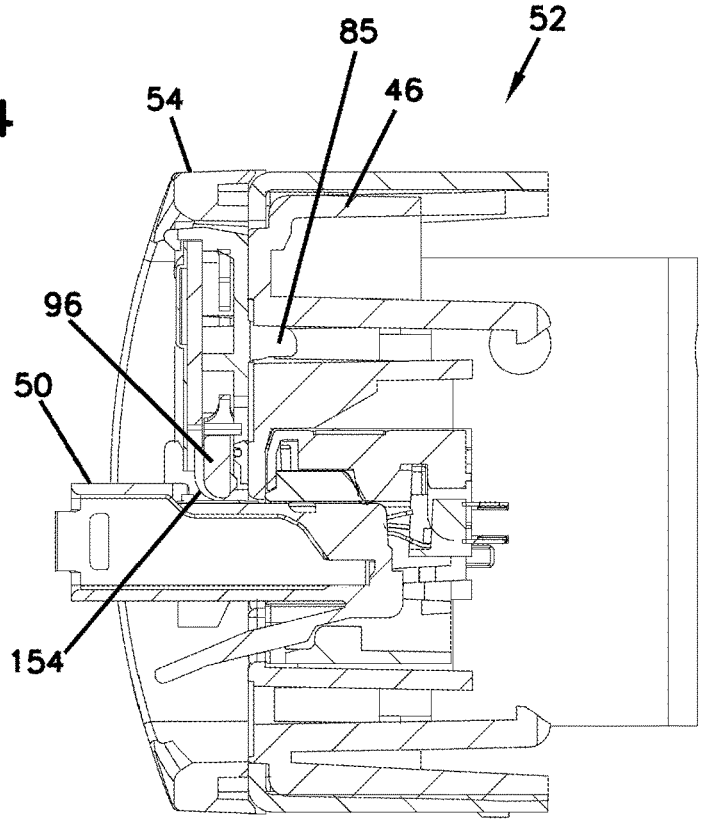
FIG. 4 is a cross-sectional view of the patch panel assembly of FIG. 3, the cross-section being taken along the line 4-4 of FIG. 3.
Figure 5:
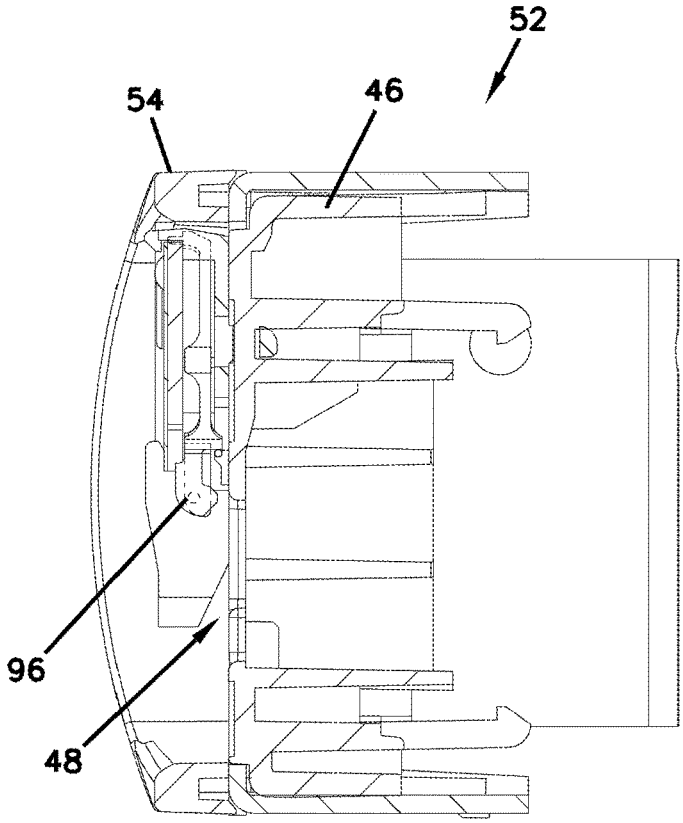
FIG. 5 is a cross-sectional view of the patch panel assembly of FIG. 3, the cross-section being taken along the line 5-5 of FIG. 3.
Figure 6:
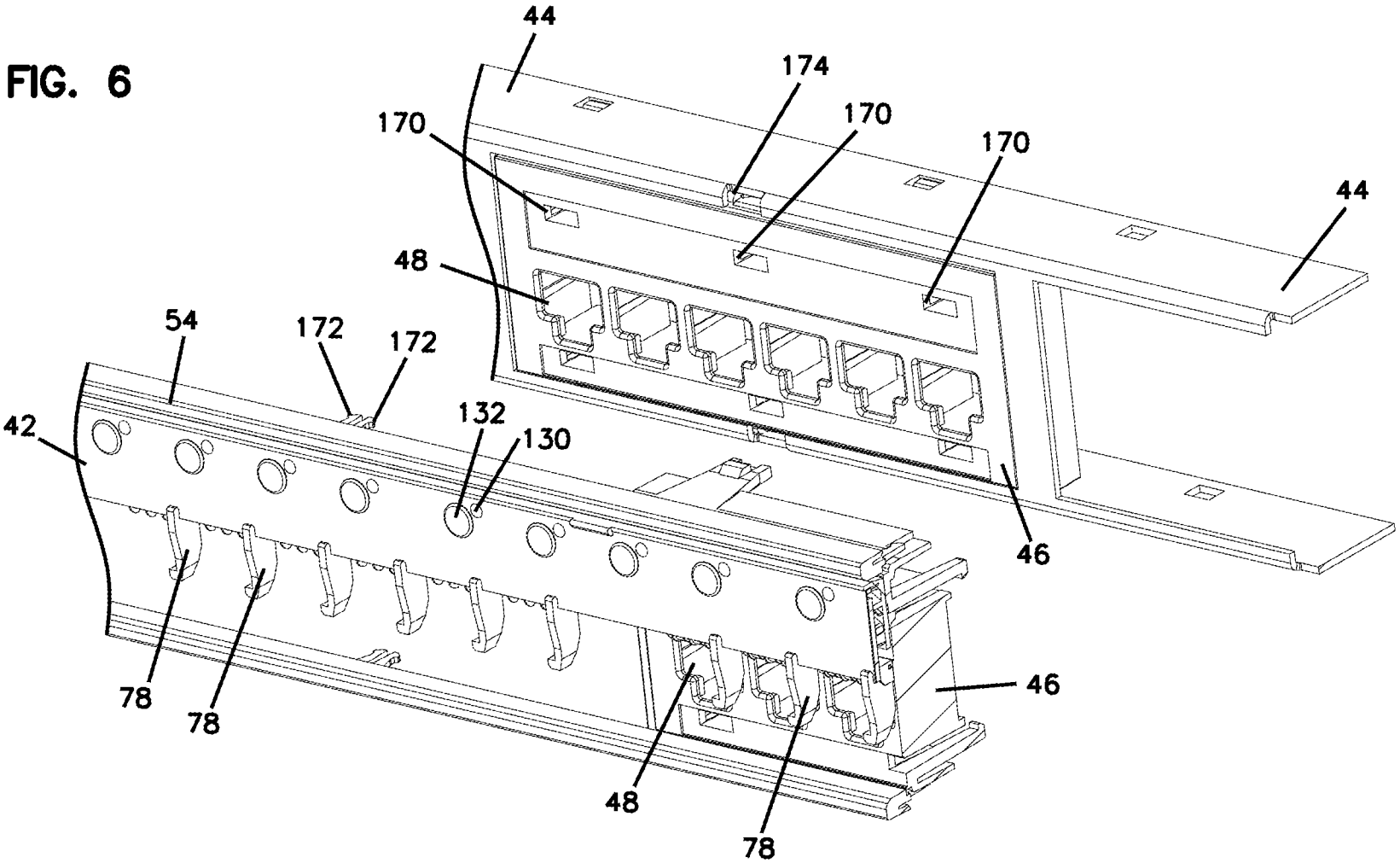
FIG. 6 is an exploded perspective view of the patch panel assembly of FIG. 3.
Figure 7:
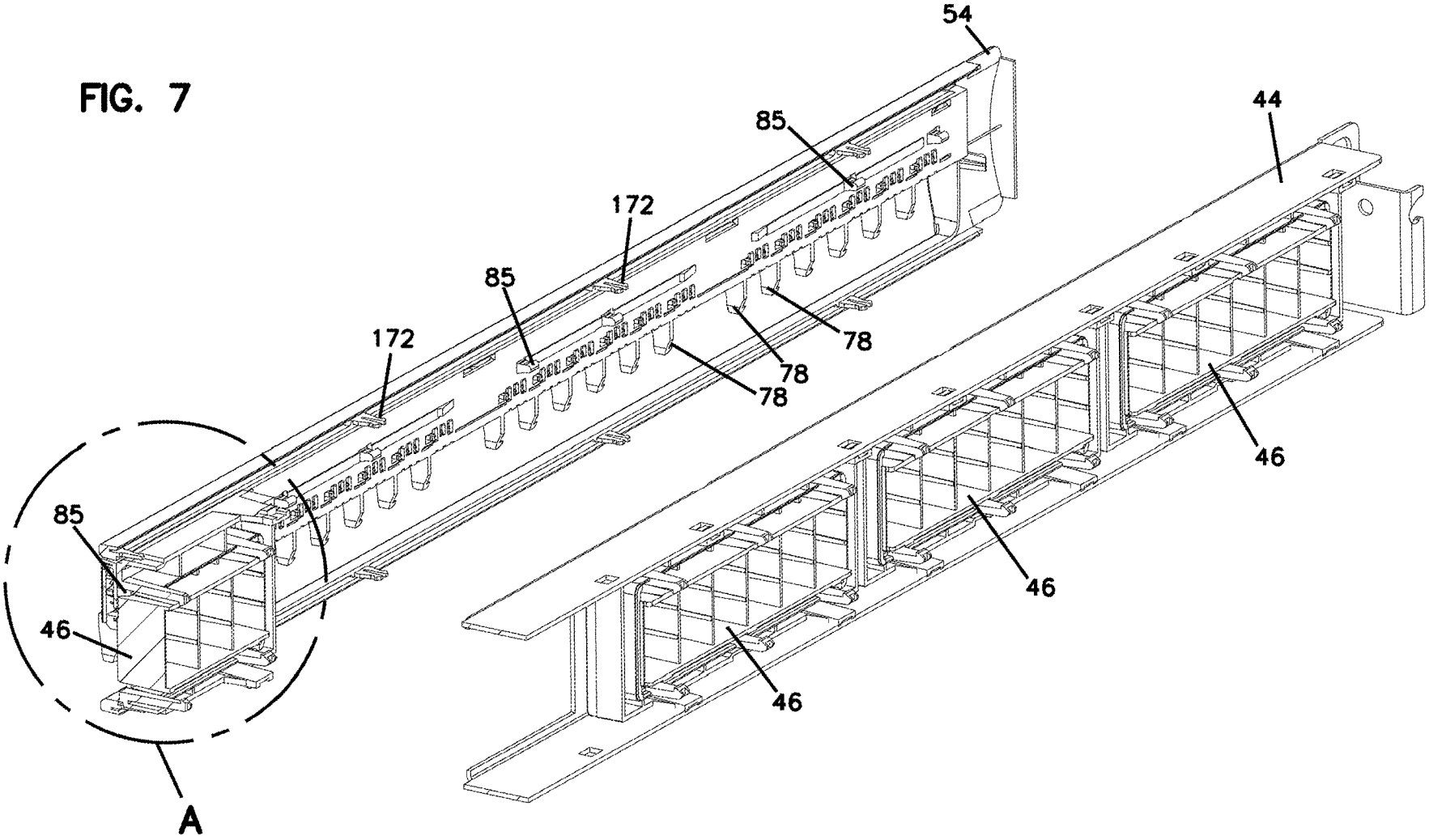
FIG. 7 is another exploded perspective view of the patch panel assembly of FIG. 3.

FIG. 4 shows a cross-sectional view of plug 50 operably mounted in one of the ports 48. There is a connection made through physical contact between the electronics unit contacts 96 and one of the plug management contacts 154 of the plug 50. FIG. 5 illustrates a cross-sectional view of the patch panel assembly 52 through a port 48 that does not have a plug 50 therein. The connection point 98 of the contact 96 in FIG. 5 is axially lower in the port 48 than in FIG. 4, in which the plug 50 moves or pushes the electronics unit contacts 96 axially upwardly.

As mentioned previously, some of the electronics unit contacts 96 are in electrical communication with conductive wire 124, when no plug 50 is inserted into the port 48. FIGS. 20 and 21 show the position of the electronics unit contacts 96 as they would appear in the ports 48 before any plug 50 is inserted. FIGS. 22 and 23 illustrate the plugs 50 when operably inserted into the ports 48. The plugs 50 move the electronics unit contacts 96 in a direction axially upwardly. This also makes electrical contact and communication between the electronics unit contacts 96 and the plug management contacts 154, 158, 160. When the electronics unit contacts 96 are moved axially upwardly, this moves the electronics unit contacts 96 that are in the first plurality of windows 90 away from and out of contact with the conductive wire 124. This indicates to the management system that plug 50 has been properly and operably oriented within the port 48. When the plug 50 is removed, the electronics unit contacts 96 move axially downwardly, which puts the contacts 96 in the first plurality of windows 90 again in contact with the conductive wire 124, creating a signal that indicates to the management system that the plug 50 has been removed.

This system can be used as part of a method of detecting the presence of plug 50 in port 48. The method includes providing at least three electronics unit contacts 96 mounted in the patch panel 40 and then checking how many of the contacts 96 are shorted together (e.g., by mutual contact with the conductive wire 124 or by a shielded plug). The method can then include inserting plug 50 into the port 48 and while inserting the plug 50, moving the three electronics unit contacts 96 so that the two of the three electronics unit contacts 96 are moved out of contact with the conductive wire 124.

This system also can be used as part of a method of reading/writing data to/from a plug 50 in a port 48. The method includes providing at least one electronics unit contacts 96 mounted in the patch panel 40 and then accessing data stored on the plug 50 via the electronics unit contact 96 and a corresponding contact pad 154, 158, 160 on the plug 50. The method can then include detecting that a plug 50 has been inserted at a port 48 and accessing the memory of the detected plug 50 via the corresponding contact pads 154, 158, 160 and contacts 96. In certain examples, the management system detects that an unshielded, managed plug 50 is received at the port 48. The management system then reads data stored at the unshielded, managed plug 50. In some examples, data stored in the plug memory is read and provided to the management system (e.g., via the connector 94). In other examples, data is provided by the management system and written onto the plug memory.

E. Embodiment of FIGS. 26-32

FIGS. 26-32 illustrate further principles, including the use of an RJ45 plug with a non-volatile memory device, such as an EEPROM, that is compatible with memory device contacts either on a retrofittable electronics unit, such as described above at reference numeral 42, or built into the port of the RJ45 jack. The port of the RJ45 jack can be located in a patch panel or other network device, such as a network switch. The same plug can be used in both designs. This advantageous feature is described further below.

Figure 26:
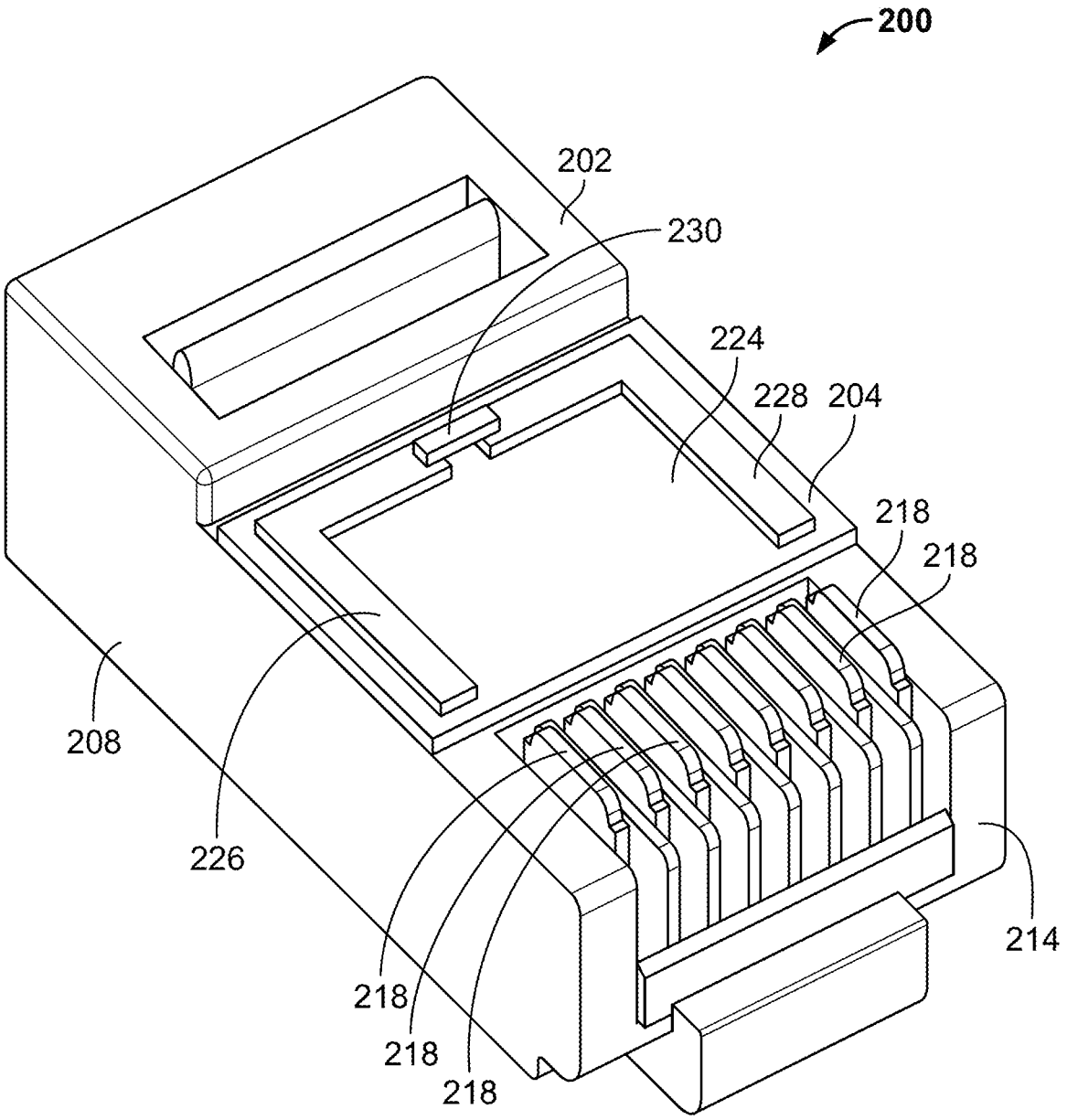
FIG. 26 is a perspective view of another embodiment of a plug, constructed in accordance with principles of this disclosure.
Figure 27:
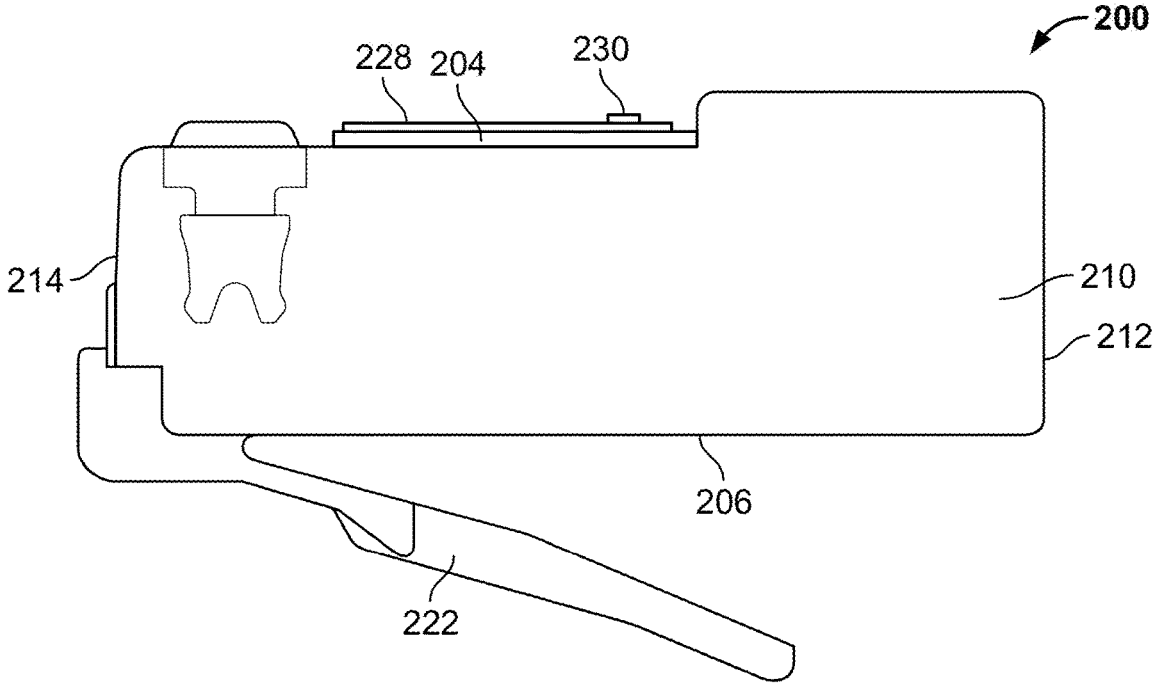
FIG. 27 is a side view of the plug of FIG. 27.

FIGS. 26 and 27 illustrate a plug 200. The plug 200 includes a plug body 202 having a first wall or surface 204 and an opposite second wall or surface 206. In the illustrated embodiment, the first surface 204 corresponds to a top surface, while the second wall 206 corresponds to a bottom surface.

The plug body 202 further includes first and second opposite sides 208, 210 between the first and second surfaces 204, 206. The body 202 also has opposite first and second ends 212, 214 between the first and second surfaces 204, 206. The first end 212 has an opening 216. The opening 216 is for receiving an electrical cable, such as a twisted pair cable as known in the art. The second end 214 carries a plurality of metal contacts, which are primary signal contacts 218. The primary signal contacts 218 are in communication with media segments (conductive wires, etc.) of the cable terminated by the plug 200. Accordingly, signals carried over the media segments of the cable are received at and transmitted through the primary signal contacts 218. The primary signal contacts 218 provide an electrical connection between the cable and the primary contacts in the ports 220 (FIG. 28) of the patch panel assembly, such as patch panel assembly 52 shown in the previous embodiments.

The plug 200 also includes a locking latch finger 222 that will releasably lock the plug 200 into the port 220, as is well known in the art.

The plug 200 includes first and second plug management contacts 226, 228. The plug management contacts 226, 228 are preferably located at opposite sides (ends) of the primary signal contacts 218. In the embodiments illustrated, the first plug management contact 226 is adjacent the first side 208, and the second plug management contact 228 is adjacent the second side 210. In this embodiment, the plug management contacts 226, 228 are generally outside of the primary signal contacts 218; that is, the primary signal contacts 218 are between the first plug management contact 226 and second plug management contact 228. Generally, there are eight primary signal contacts 218, in a row, with the plug management contacts 226, 228 being laterally offset from the primary signal contacts 218. Other embodiments are possible, but this arrangement leads to advantage. Because the plug management contacts 226, 228 are located laterally offset from primary contacts 218, the plug 200 can be placed in the jack without risk of secondary (management) jack contacts engaging the primary signal contacts or vice versa.

The plug 200 includes a memory at which data (e.g., physical layer information) can be stored and a processor configured to access the memory. In the example shown, the processor and memory are provided by a non-volatile memory device 230, such as an EEPROM in communication with the plug management contacts 226, 228. In FIG. 26, it can be appreciated that the non-volatile memory device 230 is centered between the first contact pad 226 and second contact pad 228. Other arrangements are possible. The non-volatile memory device 230 can be mounted to same surface as the primary signal contacts 218 and/or the plug management contacts 226, 228. In some examples, the non-volatile memory device 230 can be located between and behind the plug management contacts 226, 228. In one example, the non-volatile memory device 230 is planar with the plug management contacts 226, 228.

The first surface 204 includes a planar region 224. The planar region 224 holds a first planar contact pad, which forms the first plug management contact 226) and a second planar contact pad, which forms the second plug management contact 228. In the example embodiment, the plug management contact pads 226, 228 and the non-volatile memory device 230 are on the top or first surface 204. In this manner, when the plug 200 is inserted into port 220, the contact pads 226, 228 will be in position to make electrical contact with port management contacts, as described further below.

While in this embodiment only two contact pads 226, 228 are illustrated, in other examples, the plug 200 can have more than two. In general, each contact pad 226, 228 (plug management contact) is configured to contact a port management contact for each port 220, when the plug 200 is received into the port 220.

Figure 28:
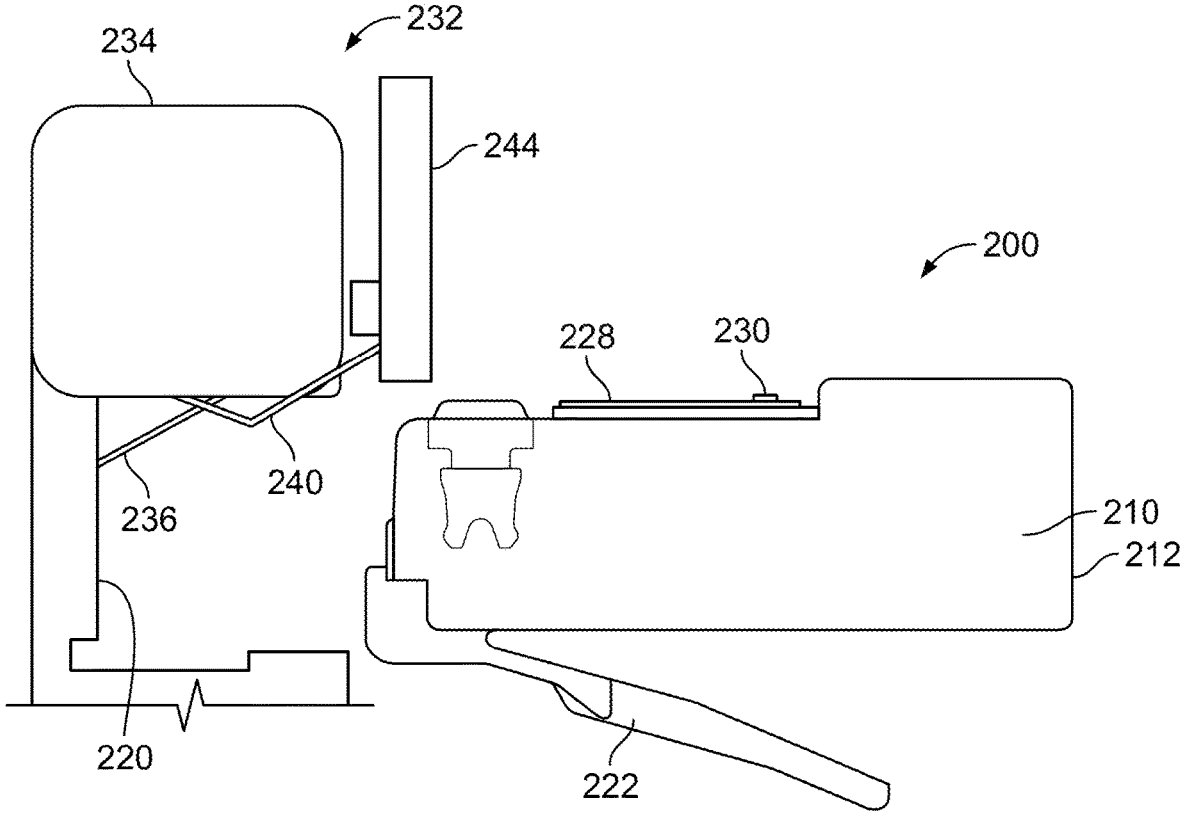
FIG. 28 is a schematic, side view of the plug of FIG. 26 being inserted into the port of a network device, the example shown here as a patch panel assembly having a retrofitted electronics unit.

In reference now to FIG. 28, one example of a network device having an RJ45 port is illustrated as a patch panel assembly 232. While patch panel 232 is shown in this embodiment, it should be understood that any network device utilizing an RJ45 port could be shown, including, e.g., a network switch. In the particular example shown, the patch panel assembly 232 can be as generally described above in FIGS. 2-9 and as shown at reference numeral 52. FIG. 28 is a schematic view of the side of port 220 for a patch panel assembly 232.

In FIG. 28, the patch panel assembly 232 includes a housing 234. The housing 234 includes a plurality of ports 220, with only one port being illustrated in FIG. 28. Again, reference is made to the patch panel assembly of FIG. 2 that shows a plurality of ports.

Figure 29:
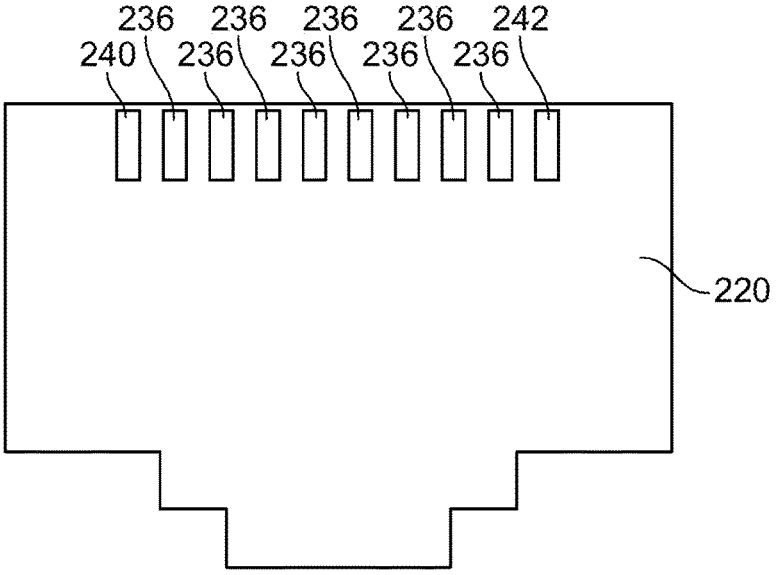
FIG. 29 is a schematic front view of the port of FIG. 28.

Each port 220 has a plurality of signal contacts 236 (FIG. 29). The signal contacts 236 are for making electrical connection with the primary signal contacts 218 of the plug 200.

Each port 220 is sized to receive plug 200 such that the primary signal contacts 218 of the plug 200 can make electrical connection with the port signal contacts 236.

In accordance with principles of this disclosure, each port 220 has at least a first port management contact 240 and a second port management contact 242. Preferably, the ports 220 are arranged such that the signal contacts 236 are in between the management contacts 240, 242. The first and second port management contacts 240, 242 are for connecting with the plug management contacts 226, 228.

The first and second port management contacts 240, 242 can either be hardwired as a part of the port 220 in the housing 234 (FIG. 30); or it can be part of an electronics unit 244 that is retrofittable onto the patch panel assembly 232. The electronics unit 244 can be as described above with respect to electronics unit 42, but modified to include the port management contacts 240, 242.

In FIG. 28, the first and second port management contacts 240, 242 are secured to the electronics unit 244. For example, the management contacts 240, 242 are on the electronics unit 244, which is outside of the port 220 (jack opening), and extend into the port 220 (jack opening) so that they can contact the contact pads 226, 288 on the inserted plug 200. In this way, the patch panel assembly 232, when retrofitted with the electronics unit 244 will have the port management contacts 240, 242 that can make electrical connection with the contact pads 226, 228 of the plug 200.

Figure 30:
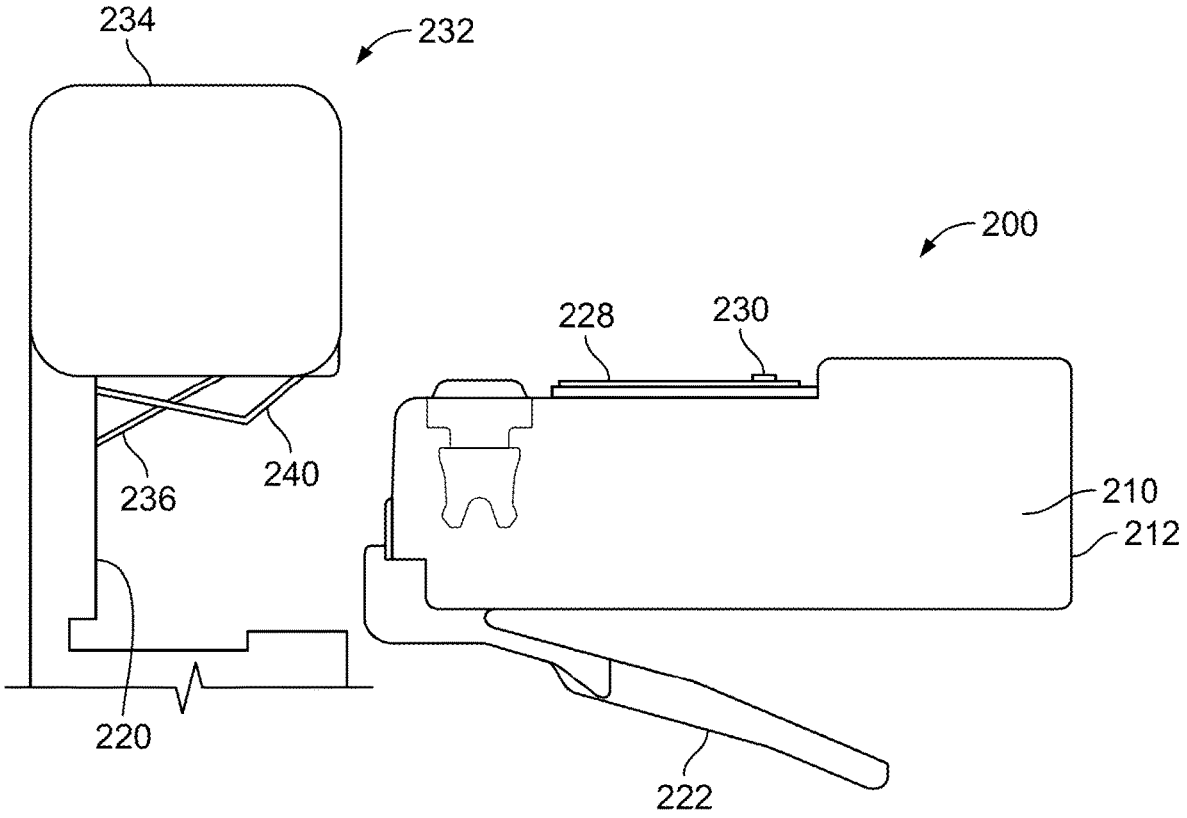
FIG. 30 is a schematic side view of the plug of FIG. 26 being inserted into the port of a patch panel assembly, constructed in accordance with principles of this disclosure.
Figure 31:
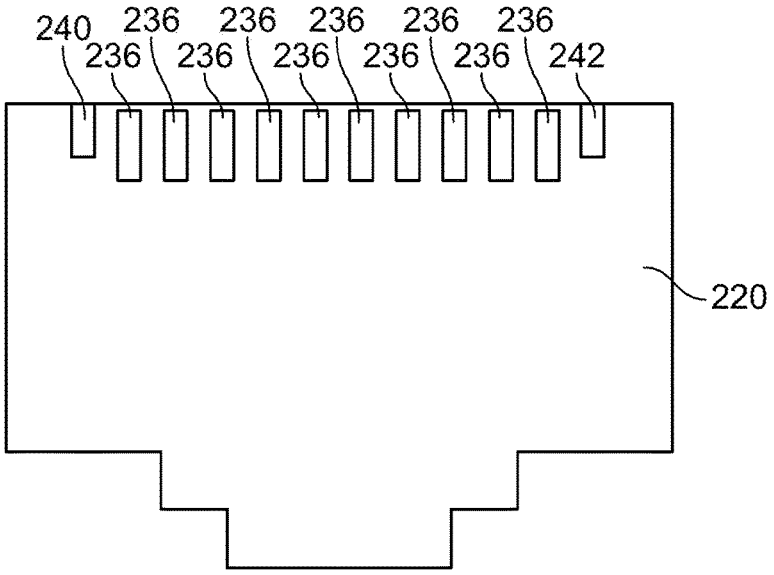
FIG. 31 is a schematic front view of the port of FIG. 30.

In FIG. 30, the first and second port management contacts 240, 242 are held by the housing 234 as part of a first fit, and hardwired to the housing 234. That is, the first and second port management contacts 240, 242 are not part of the retrofit of FIG. 28. The contacts 240, 242 are oriented such that they make electrical contact with the first and second contact pads 226, 228 that form the plug management contacts.

Figure 32:
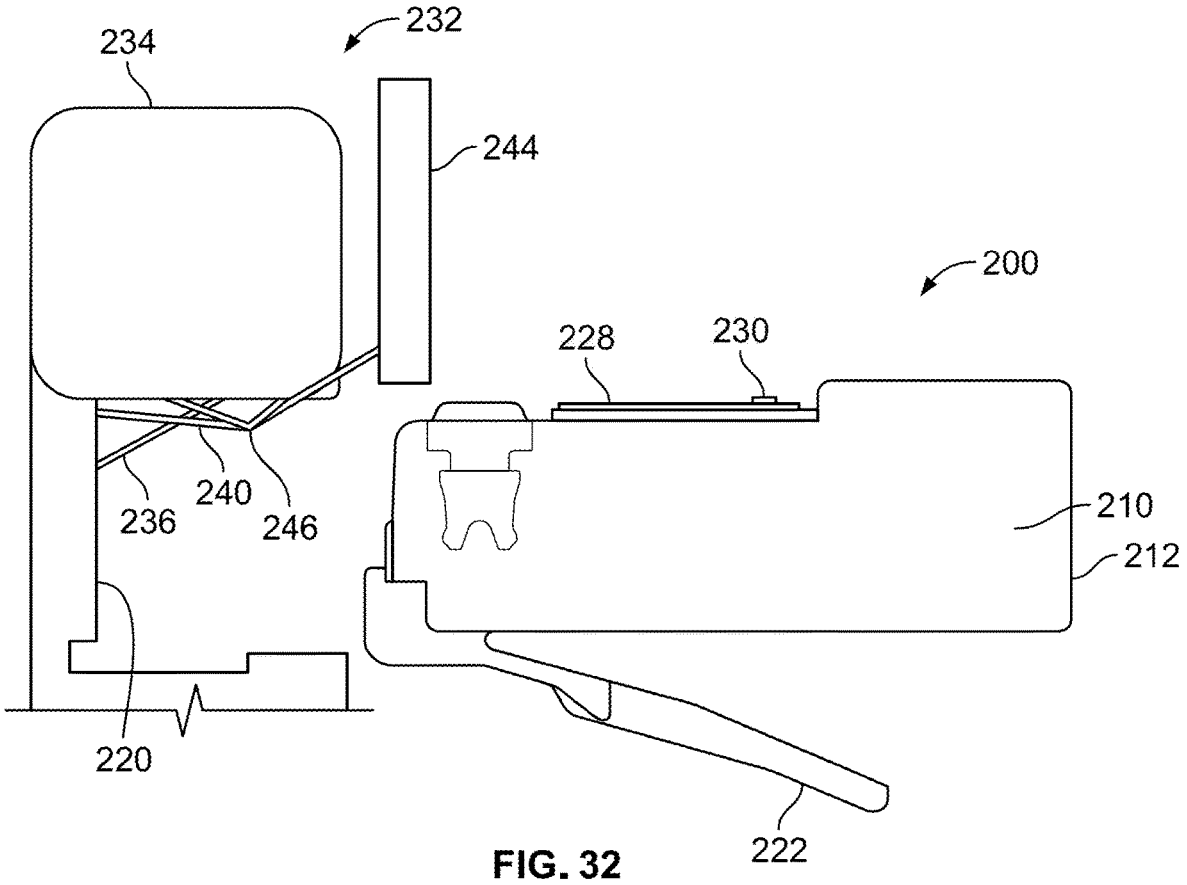
FIG. 32 is a schematic side view of the plug of FIG. 26 and a combination of the ports of FIGS. 28 and 30 to demonstrate the same contact location of the management contacts of the port in the patch panel assembly.

Attention is directed to FIG. 32. FIG. 32 is a schematic view showing the port management contacts 240, 242 schematically as either being part of the electronics unit 244 or as being hardwired as a part of the patch panel assembly 232. In both cases, the port management contacts 240, 242 each come to a point or apex 246, which is positioned to make electrical contact with the management contacts 226, 228 of the plug 200. Therefore, it should be understood that the plug 200 is universal in that it can be used with a port 220 that is either hardwired to have the port management contacts 240, 242, as shown in FIG. 30, or is retrofitted with electronics unit 244 to have the port management contacts 240, 242.

A method for reading management data from a plug can be practiced using the embodiments of FIGS. 26-32. The method includes inserting plug 200 having metal contacts 218 into port 220 of patch panel assembly 232. The plug 200 also has first and second plug management contacts 226, 228.

Next, there can be a step of electrically connecting the first and second plug management contacts 226, 228 with first and second port management contacts 242, 244.

There may also be a step of electrically connecting the plug metal contacts 218 with a plurality of signal contacts 236 in the port 220. Preferably, the signal contacts 236 are oriented between the port management contacts 240, 242.

The step of electrically connecting the first and second plug management contacts 226, 228 includes connecting the first and second plug management contacts 226, 228 to first and second port management contacts 240, 242 secured to electronics unit 244 that is retrofittable onto the patch panel assembly 232.

The step of electrically connecting the first and second plug management contacts 226, 228 includes connecting the first and second plug management contacts 226, 228 to the first and second port management contacts 240, 242 held by the housing 234.

The above represents example principles. Many embodiments can be made using these principles.

What is claimed is:

1. A patch panel assembly comprising:

(a) a frame;

(b) at least one chassis held by the frame, the chassis including a plurality of ports adapted to receive plugs, the plugs having one or more plug management contacts; and (c) an electronics unit held by the chassis, the electronics unit including a circuit board retained between a base and a cover plate that are secured together, the circuit board including electronics unit contacts for electronic communication with the one or more plug management contacts; the electronics unit being retrofittable into the patch panel assembly.

2. The patch panel assembly of claim 1 further comprising a faceplate mounted to the frame and locking the electronics unit between the frame and the chassis.

3. The patch panel assembly of claim 1, wherein:

(a) the electronics unit includes at least one hook extending therefrom; and (b) the at least one chassis includes a receiving cavity;

(i) the at least one hook extending into the receiving cavity and engages a portion of the at least one chassis.

4. The patch panel assembly of claim 1, wherein:

(a) the at least one chassis includes a plurality of chassis, each chassis having a plurality of ports, and each chassis being held by the frame;

(b) the electronics unit includes at least three electronics unit contacts associated with each of the ports; and (c) a plurality of plugs are mounted in at least some of the ports; each plug having at least three plug management contacts in electrical communication with the at least three electronics unit contacts for the associated port.

5. A patch panel assembly comprising:

(a) a frame;

(b) at least one chassis held by the frame, the chassis including a plurality of ports adapted to receive plugs, the plugs having one or more plug management contacts; and (c) an electronics unit held by the chassis including a circuit board and electronics unit contacts for electronic communication with the one or more plug management contacts; the electronics unit being retrofittable into the patch panel assembly, the electronics unit including a plurality of spaced plug guides extending therefrom; each plug guide being adjacent to one of the ports.

6. A patch panel assembly comprising:

(a) a frame;

(b) at least one chassis held by the frame, the chassis including a plurality of ports adapted to receive plugs, the plugs having one or more plug management contacts; and (c) an electronics unit held by the chassis including a circuit board and electronics unit contacts for electronic communication with the one or more plug management contacts; the electronics unit being retrofittable into the patch panel assembly, wherein the electronics unit comprises:

(1) a base having a holding section and a plurality of spaced plug guides extending from one edge; and (2) a circuit board secured to the holding section of the base, the circuit board including, (i) at least one connector for connection to a management system;

(ii) and wherein the plurality of electronics unit contacts are secured to the circuit board, the electronics unit contacts having connection points that are movable relative to the circuit board in response to contact with a plug that has been inserted into a port in the patch panel assembly.

7. The patch panel assembly of claim 6 further including at least one plug operably mounted in one of the ports, the at least one plug having one or more plug management contacts in electrical communication with the electronics unit contacts of the electronics unit; and wherein the at least one plug moves the electronics unit contacts in an axial direction when operably mounted in the port.

8. The patch panel assembly of claim 6 wherein:

(a) the base of the electronics unit includes a plurality of windows; and (b) each of the electronics unit contacts in the circuit board are in communication one of the windows in the base.

9. The patch panel assembly of claim 8 wherein:

(a) the electronics unit includes a channel, a first plurality of the windows being open to the channel, a second plurality of the windows being blocked from the channel, and a conductive wire being held by the channel; and (b) the electronics unit contacts in communication with the first plurality of windows are in electrical contact with the conductive wire when there is no plug inserted in a port in the patch panel assembly, and the electronics unit contacts in communication with the second plurality of windows are blocked from contact with the conductive wire.

10. The patch panel assembly of claim 9 further including at least one plug operably mounted in one of the ports, the at least one plug having one or more plug management contacts in electrical communication with the electronics unit contacts of the electronics unit; and wherein the plug moves the electronics unit contacts out of electrical contact with the conductive wire.

11. The patch panel assembly of claim 10, wherein the electronics unit includes a plurality of spaced plug guides extending therefrom, each plug guide being adjacent to one of the ports; and wherein one of the plug guides is adjacent to the at least one plug.

12. The patch panel assembly of claim 7, wherein the plug includes:

(a) a body having first and second opposite walls, first and second opposite sides between the first and second walls, and opposite first and second ends between the first and second walls;

(i) the first end having an opening for receiving an electrical cable;

(ii) the second end having a plurality of metal contacts; and (iii) the first wall having at least one or more of the plug management contacts extending in a plane and an EEPROM in communication with the at least one or more plug management contacts.

13. A plug comprising:

(a) a body having first and second opposite walls, first and second opposite sides between the first and second walls, and opposite first and second ends between the first and second walls;

(i) the first end having an opening for receiving an electrical cable;

(ii) the second end having a plurality of metal contacts; and (iii) the first wall having at least one uncovered planar contact pad and an uncovered non-volatile memory device in communication with the at least one planar contact pad.

14. The plug of claim 13, wherein the at least one contact pad includes three planar contact pads.

15. A plug comprising:

(a) a body having first and second opposite walls, first and second opposite sides between the first and second walls, and opposite first and second ends between the first and second walls;

(i) the first end having an opening for receiving an electrical cable;

(ii) the second end having a plurality of metal contacts; and (iii) the first wall having at least one planar contact pad and a non-volatile memory device in communication with the at least one planar contact pad, wherein the first wall includes a planar pad region holding the at least one contact pad and an adjacent stepped region with a riser therebetween; the riser defining a notch holding the non-volatile memory device therein.

16. A plug comprising:

(a) a body having first and second opposite walls, first and second opposite sides between the first and second walls, and opposite first and second ends between the first and second walls;

the first end having an opening for receiving an electrical cable;

(ii) the second end having a plurality of metal contacts; and (iii) the first wall having at least one planar contact pad and a non-volatile memory device in communication with the at least one planar contact pad, wherein the at least one contact pad includes three planar contact pads, wherein the three contact pads extend substantially a complete width across the first wall between the first and second sides.

17. A network device comprising:

(a) a housing;

(b) a plurality of ports;

(i) each port having a plurality of signal contacts;

(ii) each port being sized to receive a plug having metal contacts for electrical connection with the signal contacts; and (iii) each port having a first port management contact and a second port management contact, with the signal contacts in between; the first and second port management contacts being configured to connect with plug management contacts on a plug, the first and second port management contacts each including an insulative separator disposed at a respective distal end.

18. The network device of claim 17 wherein the first and second port management contacts are secured to an electronics unit that is retrofittable onto the network device.

19. The network device of claim 17 wherein the first and second port management contacts are held by the housing.

20. The network device of claim 17, further comprising a plurality of plugs mounted in at least some of the ports; each plug having first and second plug management contacts in electrical communication with the first port management contact and a second port management contact of the network device.

* * * * *